United States Patent [19]

Moffat

[11] Patent Number: 5,037,716

[45] Date of Patent: Aug. 6, 1991

[54] ENCAPSULATED TONERS AND PROCESSES THEREOF

[75] Inventor: Karen A. Moffat, Brantford, Canada

[73] Assignee: Xerox Corporation, Stamford, Conn.

[21] Appl. No.: 415,745

[22] Filed: Oct. 2, 1989

[51] Int. Cl.[5] ..... G03G 5/00; G03G 9/00; G03C 1/72

[52] U.S. Cl. ..... 430/109; 430/137; 430/138

[58] Field of Search ..... 430/138, 109, 137

[56] References Cited

U.S. PATENT DOCUMENTS

| | | | |
|---|---|---|---|
| 3,970,501 | 7/1976 | Miyamoto et al. | 156/328 |
| 4,199,400 | 4/1980 | Bakule et al. | 524/521 |
| 4,563,212 | 1/1986 | Becher et al. | 71/11 |
| 4,785,048 | 11/1988 | Chao | 524/745 |

*Primary Examiner*—John Goodrow
*Assistant Examiner*—S. Crossan
*Attorney, Agent, or Firm*—E. O. Palazzo

[57] ABSTRACT

An encapsulated toner composition comprised of a core comprised of a preformed polymer and/or monomer or monomers, a free radical initiator, pigment or dye particles, which core is dispersed in an emulsifier solution, and subsequently encapsulated in a polymeric shell and wherein the toner is stabilized by dispersants during core polymerization, which dispersant is of the following formula

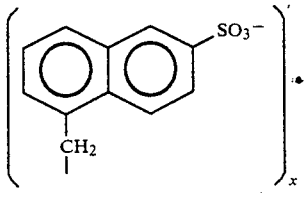

wherein x represents the number of repeating units.

76 Claims, No Drawings

ENCAPSULATED TONERS AND PROCESSES THEREOF

BACKGROUND OF THE INVENTION

The present invention is generally directed to toner compositions, and more specifically to encapsulated colored heat fusible toner compositions. In one embodiment, the present invention is related to encapsulated toner compositions comprised of a core with a polymeric shell thereover preferably prepared by interfacial polymerization. Another specific embodiment of the present invention relates to encapsulated toner compositions comprised of a core containing a preformed polymer and/or monomer or monomers, a free radical initiator, pigment or dye particles and wherein the core which is dispersed into an emulsifier solution is subsequently encapsulated by a polymeric shell, and wherein the toner is stabilized by dispersants at elevated temperatures during core polymerization via free radical polymerization.

Toners suitable for use in electrophotographic copiers and printers may include therein a wide variety of colors, such as black, red, green, blue, brown, yellow, purple, silver and gold. When it is desired to highlight certain features of a document, one or more colored toners are typically used in conjunction with a black toner to provide an image in two or more colors. Full color images can also be generated by developing images with cyan, magenta, yellow and black toners. Generally, it is advantageous for such toners to exhibit low melting temperatures to enable low energy fusing of the developed images to substrates at lower temperatures and lower pressures of, for example, 400 psi versus, for example, about 4,000 psi for cold pressure fixable applications. It is also often advantageous for such toners to possess mean particle diameters of from about 5 microns to about 35 microns and preferably from about 5 microns to about 15 microns to enable images of high resolution, low image noise and high color fidelity. Further, it is generally desirable for these small diameter toners to have very narrow size distributions, preferably with a GSD (Geometric Standard Deviation) of 1.5 or less, to avoid difficulties in the electrophotographic development and transfer associated with oversize toner particles and extremely fine toner particles. These and other advantages can be achieved with the encapsulated toners and processes of the present invention. More specifically, an advantage associated with toner particles of the present invention is the enablement of the stabilization of toner particles at elevated temperatures during core monomer polymerization by the addition of dispersing components including those available as Daxad TM from W. R. Grace Chemical Company. The aforementioned stabilization enables the utilization of less emulsifier for the toner particle generation step, and therefore the emulsifiers primary function is to control the particle size of the toner generated during the dispersion of the organic phase into the aqueous phase, and moreover the dispersing agents can be selected for stabilization of the toner particles. Further, reducing the quantity of emulsifier selected results in the generation of less fine particles with an average particle diameter of less than about 1 micron thereby enabling, for example, toner particles with clean surfaces. Additionally, with the toner particles and processes of the present invention there is eliminated or minimized undesirable particle agglomeration, especially at elevated temperatures, and furthermore by the incorporation of certain dispersants there is permitted toner particles with heat fusible cores (Tg less than 55° C.) and heat fusible shells with a Tg of, for example, less than 100° C., which particles remain as discrete primary particles subsequent to the free radical polymerization. The addition of dispersants prior to core monomer polymerization when emulsifiers such as polyvinyl alcohol are utilized enable a reduction of grafting or shell incorporation of such emulsifier on the toner particle surface primarily, it is believed, since a minimum amount of emulsifier is needed to generate the desired particle size. By reducing the grafting of the emulsifier such as polyvinyl alcohol, onto or into the shell there is enabled lower heat fusible toners since the thermal properties of the shell are usually not increased. Also, it is advantageous to add the dispersants illustrated herein to the toner synthesis in some embodiments prior to free radical polymerization particularly since its stabilization capabilities permits increased loading of the organic phase into the aqueous phase thereby allowing increased toner throughput. The addition of dispersing agent prior to core polymerization can also desirably influence the triboelectric charging properties of the toner, and can, in some instances, function as a negative charge control additive. Further, the incorporation of the aforementioned dispersants as charge control additives during interfacial polymerization reduces the number of process steps and moreover the dispersant can be incorporated into the shell in some embodiments but may not strengthen or reinforce the shell as in the situation with poly(vinyl alcohol). Also, in some embodiments the dispersants selected for the toners and processes of the present invention do not increase the fusing temperatures of the toner or only cause minimum increases in the aforementioned temperatures.

The toner compositions of the present invention can be selected for a variety of known imaging and printing processes including electrophotographic, electrographic or magnetographic processes. Specifically, the toner compositions of the present invention can be selected for xerographic imaging and printing processes, such as two component development systems and single component development systems both magnetic and nonmagnetic along with ionographic processes wherein dielectric receivers such as silicon carbide are utilized, reference U.S. Pat. No. 4,885,220 entitled Amorphous Silicon Carbide Electroreceptors, the disclosure of which is totally incorporated herein by reference.

In a patentability search report, there were recited as prior art the following U.S. Pat. No. 4,727,101, the disclosure of which is totally incorporated herein by reference, which illustrates a free radical polymerization of a toner shell at elevated temperatures and more specifically is directed to the preparation of encapsulated toner compositions, which comprises mixing in the absence of a solvent a core monomer initiator, pigment particles, a first shell monomer, stabilizer, and water, and thereafter adding a second shell monomer to enable interfacial polymerization interaction, and subsequently affecting the free radical polymerization of the core monomer, reference the Abstract of the Disclosure for example; U.S. Pat. No. 4,777,104 which relates to processes for the formation of electrophotographic toners of certain desired sizes by radical polymerization, reference for example column 3, lines 26 to 41, and also note the disclosure in column 6 with respect to colorants beginning at line 29; U.S. Pat. No. 4,524,199, the disclosure of which is totally incorporated herein by reference, which relates to stable polymeric dispersions, which dispersion comprises, for example, a polar dispersion medium having dispersed therein particles comprising a thermoplastic resin core having irreversibly anchored thereto a nonionic amphipatic steric stabilizer comprising a graph copolymer, reference for example column 2, beginning at line 45, and note column 4, beginning at line 57, and continuing on to column 5; U.S. Pat. No. 4,533,617 directed to heat fixable developers with a capsule structure containing a binder resin of a certain glass transition temperature and a colorant coated with a vinyl type polymer, reference for example the Abstract of the Disclosure, and note columns 4 through 10; U.S. Pat. No. 4,725,522 directed to processes for cold pressure fixable encapsulated toner compositions, particularly processes thereof wherein a water phase containing a stabilizing material is selected and hydrolysis is accomplished by heating and there is utilized interfacial polymerization to form the shell, reference for example the Abstract of the Disclosure, and also note columns 4 to 8, the disclosure of the aforementioned patent being totally incorporated herein by reference; U.S. Pat. No. 3,876,610 relating to the preparation of electrostatic toner materials with a size of between 1 to 10 microns and containing a polymeric shell comprising a copolymer with a glass transition temperature of at least 40° C., see the Abstract of the Disclosure, for example; and U.S. Pat. No. 4,762,752 which discloses addition compounds suitable as dispersing agents, reference the Abstract of the Disclosure, for example.

Additionally, there is illustrated in U.S. Pat. No. 4,565,764 a pressure fixable microcapsule toner having a colored core material coated successively with a first resin wall and a second resin wall. The first resin wall has affinity to both the core material and the second resin wall. This patent discloses that the first resin wall may be of a material that becomes charged to a polarity opposite to that of the second resin wall and the core material.

Furthermore, U.S. Pat. No. 4,520,091 discloses a pressure fixable encapsulated electrostatographic toner material. The core comprises a colorant, a polymer, a solvent capable of dissolving the polymer or causing the polymer to swell, and an organic liquid incapable of dissolving the polymer or causing the polymer to swell, and the shell may consist of a polyamide resin. Preparation of the toner material is completed by interfacial polymerization.

Another patent, U.S. Pat. No. 4,708,924, discloses a pressure fixable microcapsule type toner composed of a core material and an outer wall over the core material. The core material contains at least a combination of a substance having a glass transition point within the range of −90° C. to 5° C. with a substance having a softening point within the range of 25° C. to 180° C. This toner composition may comprise substances such as polystyrene and poly(n-butyl)methacrylate and their copolymers.

Further, U.S. Pat. No. 4,254,201 discloses a pressure sensitive adhesive toner consisting essentially of porous aggregates. Each aggregate consists essentially of a cluster of a multiplicity of individual granules of pressure sensitive adhesive substance, each granule being encapsulated by a coating film of a film-forming material. Particles of an inorganic or organic pigment and/or a magnetic substance are contained within the aggregate in the interstices between the granules and deposited on the surfaces of the encapsulated granules. The adhesive substance is selected from a copolymer of at least one monomer and as many as three other monomers.

In addition, U.S. Pat. No. 4,702,988 discloses a process for the preparation of encapsulated toner. A monomer composition and a colorant are dispersed in a liquid dispersion medium in the presence of a solid fine powdery dispersion stabilizer. The liquid is pressurized and then ejected into a low pressure section to form particles of monomer composition. These particles are then subjected to suspension polymerization to produce toner particles.

In U.S. Pat. No. 4,727,011 there is disclosed a process for preparing encapsulated toner compositions which comprises mixing, in the absence of a solvent, a core monomer, an initiator, pigment particles, a first shell monomer, stabilizer, and water; thereafter adding a second shell monomer, thereby enabling an interfacial polymerization reaction between the first and second shell monomers; and subsequently effecting a free radical polymerization of the core monomer. The disclosure of this patent is totally incorporated herein by reference.

Moreover, U.S. Pat. No. 4,766,051, the disclosure of which is totally incorporated herein by reference, illustrates an electrophotographic developer composition comprising a cold pressure fixable colored toner composition which comprises a core containing a polymer in which is dispersed pigment particles selected from the group consisting of cyan, magenta, red, yellow pigments, and mixtures thereof, other than carbon blacks and magnetites; and encapsulated within a polymeric shell formulated by an interfacial polymerization. Also, U.S. Pat. No. 4,725,522 discloses a process for preparing cold pressure fixable toner compositions which comprises admixing a core component comprising pigment particles, a water insoluble organic solvent and elastomeric materials with a shell monomer dissolved therein, and dispersing the resulting mixture in a water phase.

In U.S. Pat. No. 4,563,212, the disclosure of which is totally incorporated herein by reference, Becher et al., describes a microencapsulation procedure based upon an interfacial polymerization reaction wherein the material to be encapsulated is an agricultural chemical such as an herbicide, an insecticide, a plant growth regulator or a herbicidal antidote. Becher et al., discloses a process wherein a water immiscible material containing the first shell wall component is emulsified into an aqueous solution containing an emulsifier selected from the group consisting of sulfonated naphthalene formaldehyde condensates, sulfonated polystyrenes and functionalized oligomers. In Becher et al., an oil-in-water emulsion is formed with the aid of high shear; the second shell wall component is added to the oil-in-water emulsion; and after a short period of time, the shear rate is reduced. Shear is continued for varying periods of time, following which salt is added to the suspension to balance its density. The formulation is subsequently bottled.

Further U.S. Pat. No. 4,785,048, the disclosure of which is totally incorporated herein by reference, discloses a process for the production of microcapsule slurry suitable for use in carbonless copy paper coatings and applications which provide microcapsules with signficant increases in capsule wall impermeability and strength. The disclosed process involves formation of microcapsule walls by hydrogen transfer polymerization in the presence of an aqueous mixture of partially hydrolyzed poly vinyl alcohol (PVA) and naphthalenesulfonic acid formaldehyde (NSF) condensate or diphenyloxide disulfonate (DDS).

There are disclosed in U.S. Pat. No. 4,307,169 microcapsular electrostatic marking particles containing a pressure fixable core, and an encapsulating substance comprised of a pressure rupturable shell, wherein the shell is formed by an interfacial polymerization. One shell prepared in accordance with the teachings of this patent is a polyamide obtained by interfacial polymerization. Furthermore, there are disclosed in U.S. Pat. No. 4,407,922 pressure sensitive toner compositions comprised of a blend of two immiscible polymers selected from the group consisting of certain polymers as a hard component, and polyoctyldecylvinylether-comaleic anhydride as a soft component. Interfacial polymerization processes are also selected for the preparation of the toners of this patent. Also, there is disclosed in the prior art encapsulated toner compositions containing pigments and dyes, reference for example the color photocapsule toners of U.S. Pat. Nos. 4,399,209; 4,482,624; 4,483,912 and 4,397,483.

There is illustrated in U.S. Pat. No. 4,937,167, the disclosure of which is totally incorporated herein by reference, a process for controlling the electrical characteristics of colored toner particles. The process comprises preparing a first core material comprising first pigment particles, core monomers, a free radical initiator, and optional polymer components, second pigment particles being of a different color from that of the first pigment particles; encapsulating separately the first core material and the second core material within polymeric shells by means of interfacial polymerization reactions between at least two shell monomers, of which at least one is soluble in aqueous media and at least one of which is soluble in organic media, wherein the polymeric shell encapsulating the first core material is of substantially the same composition as the polymeric shell encapsulating the second core material; and subsequently polymerizing the first and second core monomers via free radical polymerization, thereby enabling, for example, two encapsulated heat fusible toner compositions of different colors with similar triboelectric charging characteristics.

Illustrated in U.S. Pat. No. 4,758,506, the disclosure of which is totally incorporated herein by reference, are single component cold pressure fixable toner compositions, wherein the shell selected can be prepared by an interfacial polymerization process. A similar teaching is present in application U.S. Ser. No. 718,676, (now abandoned) the disclosure of which is totally incorporated herein by reference. In the aforementioned application, the core can be comprised of magnetite and a polyisobutylene of a specific molecular weight encapsulated in a polymeric shell material generated by an interfacial polymerization process.

Application U.S. Ser. No. 043,265/87, (now abandoned) the disclosure of which is totally incorporated herein by reference, illustrates an encapsulated composition suitable for use as an electrophotographic toner, which comprises a core encapsulated within a thermotropic liquid crystalline polymeric shell. On page 8 of this application, the specification indicates that the disclosed developer compositions can be charged to preselected values irrespective of the pigment selected for the core. In addition, U.S. Pat. No. 4,855,209, the disclosure of which is totally incorporated herein by reference, illustrates an encapsulated toner composition with a melting temperature of from about 65° C. to about 140° C. which comprises a core containing a polymer selected from the group consisting of polyethylene succinate, polyhalogenated olefins, poly(α-alkylstyrenes), rosin modified maleic resins, aliphatic hydrocarbon resins, poly(ε-caprolactones), and mixtures thereof; and pigment particles, where the core is encapsulated in a shell prepared by interfacial polymerization reactions.

Further, U.S. Pat. No. 4,851,318, the disclosure of which is totally incorporated herein by reference, illustrates an improved process for preparing encapsulated toner compositions which comprises mixing core monomers, an initiator, pigment particles, and oil soluble shell monomers, homgenizing the mixture into an aqueous surfactant solution to result in an oil-in-water suspension enabling an interfacial polymerization reaction between the oil soluble and the water soluble shell monomers, subsequently adding a low molecular weight polyethylene oxide surfactant protective colloid, and thereafter effecting free-radical polymerization of the core monomers by heating.

Free-radical polymerization is well known, and can be generalized as bulk, solution, or suspension polymerization. These polymerizations are commonly used for the manufacture of certain polymers. The kinetics and mechanisms for free-radical polymerization of monomer(s) is also well known. In these processes the control of polymer properties such as molecular weight and molecular weight dispersity can be effected by initiator, species concentrations, temperatures, and temperature profiles. Similarly, conversion of monomer is effected by the above variables.

Accordingly, there is a need for encapsulated toner compositions with many of the advantages illustrated herein. More specifically, there is a need for encapsulated toners wherein toner particle agglomeration is eliminated or minimized. Also, a need continues to exist for improved particle stabilization during free radical polymerization of heat fusible color toners suitable for use in electrophotographic copiers and printers. A need also exists for the stabilization of colored toners which exhibit low melting characteristics preferably with a low melting core Tg of less than about 55° C., and a low melting polymeric shell Tg of less than about 100° C. without particle agglomeration or coalescence during free radical polymerization thereby enabling lower fusing temperatures. A further need exists for dry colored toners with an average mean diameter of from about 5 microns to about 15 microns and a narrow geometric size distribution of less than 1.5 while avoiding micronization or classification. There is also a need for colored toner particles with clean, dirt free surfaces which aid in narrowing the size distribution (reduction of fines to, for example, less than 1 micron) and narrow the triboelectric charging distribution of the developer. Additionally, there is a need for an improved process for decreasing and/or eliminating the generation of fine particles. Also, there is a need for encapsulated colored toners wherein a minimum amount of surfactant or emulsifier is selected to generate toner size particles. There is a further need for encapsulated toners that will decrease or eliminate the grafting or incorporation of components such as poly(vinylalcohol) into the shell at elevated temperatures. Also, there is a need for encapsulated colored toners with a higher loading of organic phase in an aqueous phase. Moreover, there is a need for encapsulated toners wherein images with excellent resolution and no background development are obtained. Additionally, there is a need for encapsulated toners, including colored toners wherein the amount of emulsifier selected can be reduced. These and other needs are obtained with the encapsulated toner compositions of the present invention and the processes thereof.

SUMMARY OF THE INVENTION

It is an object of the present invention to provide encapsulated heat fusible toner compositions with many of the advantages illustrated herein.

In another object of the present invention there are provided encapsulated heat fusible toner compositions comprised of a core of polymer resin binder, pigments and/or dyes, and thereover a shell prepared, for example, by interfacial polymerization.

Another object of the present invention is the provision of encapsulated heat fusible toners wherein agglomeration or coalescence is eliminated at elevated temperatures in some embodiments, or minimized in other embodiments by incorporating a dispersing agent prior to free radical polymerization.

Further, another object of the present invention is the provision of encapsulated heat fusible toners wherein toner fines are eliminated in some embodiments, or minimized in other embodiments.

Also, another object of the present invention is the provision of processes for the preparation of encapsulated heat fusible toners wherein in addition to surfactants a dispersing component is selected.

Additionally, another object of the present invention is the provision of encapsulated heat fusible toners with extended shelf life without substantially any modifications of the characteristics thereof.

Also, another object of the present invention is the provision of colored, that is other than black, encapsulated heat fusible toners.

Another object of the present invention is the provision of encapsulated heat fusible toners that can be selected for imaging processes, including processes wherein single component development systems and two component development systems, both magnetic and nonmagnetic, along with ionographic processes are selected.

In another object of the present invention there are provided simple and economical processes for black and colored heat fusible toner compositions formulated by an interfacial/free-radical polymerization process in which the shell formation (interfacial polymerization), core formation (free radical polymerization), and resulting material properties may be independently controlled in some embodiments.

Another object of the present invention resides in simple and economical processes for black and colored heat fusible toner compositions with heat fusible shells formulated by an interfacial/free-radical polymerization process, and wherein the use of excess stabilizer is avoided.

Also, it is an object of the present invention to provide a process for preparing improved heat fusible color toners suitable for use in electrophotographic copiers and printers.

Another object of the present invention is the provision of colored toners that exhibit low melting temperatures to enable low energy fusing of the developed images to substrates at lower temperatures.

Additionally, another object of the present invention is the provision of encapsulated heat fusible colored toners that possess mean particle diameters of from about 5 microns to about 15 microns without the need for micronization or classification.

Another object of the present invention is the provision of colored heat fusible encapsulated toners with narrow size distributions, preferably with a GSD of 1.5 or less without the need for micronization and classification.

Another object of the present invention resides in the stabilization of colored heat fusible toner particles at elevated temperatures during core monomer polymerization by the addition of a dispersing agent.

In another object of the present invention there are provided toners and processes with a reduction in the amount of emulsifier selected to generate the desired particle size during the dispersion step.

Another object of the present invention is the provision of colored heat fusible toner particles with clean dirt-free surfaces.

In a further object of the present invention there are provided colored toner particles with heat fusible shells with, for example a Tg of less than 100° C., which particles do not agglomerate or coalesce at elevated temperatures during free radical polymerization enabled by the addition of Daxad TM dispersants prior to monomer polymerization.

Additionally, another object of the present invention is the provision of encapsulated heat fusible toners with improved particle stabilization ability thus enabling an increased loading of the organic phase into the aqeuous phase.

Another object of the present invention is the selection of the dispersants illustrated herein for the toner as a negative charge control additive.

These and other objects of the present invention are accomplished by the provision of toners, and more specifically encapsulated toners. In one embodiment of the present invention, there are provided encapsulated toners with a core and a polymeric shell thereover. Specifically, in one embodiment there are provided in accordance with the present invention, encapsulated toners comprised of a core containing a preformed polymer and/or a monomer or monomers, a free radical initiator, pigment or dye particles, and wherein the core is dispersed into an emulsifying solution, and subsequently encapsulated by a polymeric shell and wherein the toner is stabilized by a dispersant at elevated temperatures during core polymerization by free radical polymerization. The present invention in other embodiments is directed to an encapsulated toner composition comprised of a core comprised of a preformed polymer and/or monomer or monomers, a free radical initiator, pigment or dye particles which core is dispersed in an emulsifier solution, subsequently encapsulated by a polymeric shell and wherein the toner is stabilized by dispersants during core polymerization, which dispersant is of the following formula

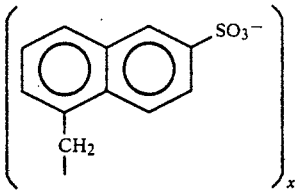

wherein x represents the number of repeating units; a heat fusible encapsulated colored toner composition comprised of a core comprised of (1) monomer or monomers, which are subsequently polymerized, preformed polymers, or mixtures thereof; (2) dispersent, pigment, dye particles or mixtures thereof, dispersed (core) in a stabilizer component, subsequently encapsulating the resulting components in a polymeric shell where the dispersant is of the following formula

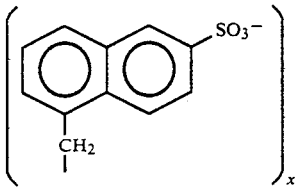

wherein x represents the number of repeating units; a process for the preparation of encapsulated colored toners which comprises preparing a first core material comprising first pigment particles, core monomer or core monomers, and a free radical initiator; preparing a second core material which comprises second pigment particles, core monomer or monomers, and a free radical initiator, said second pigment particles being of a different color from that of the first pigment particles; dispersing the first and second core materials into an aqueous emulsifying phase; encapsulating separately the first core material and the second core material within polymeric shells by interfacial polymerization reactions between at least two shell monomers, of which at least one is soluble in aqueous media and at least one of which is soluble in organic media, wherein the polymeric shell encapsulating the first core material is of substantially the same composition as the polymeric shell encapsulating the second core material; stabilizing the encapsulated toner particles with a dispersant of the following formula;

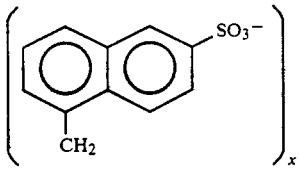

wherein x represents the number of repeating units; and subsequently polymerizing the first and second core monomer or monomers via free radical polymerization, thereby enabling two encapsulated toner compositions of different colors; and a process for the preparation of an encapsulated toner composition which comprises (1) preparing a core component comprising
  (a) pigment particles wherein the pigment is flushed into a resin comprising a styrene-n-butylmethacrylate copolymer;
  (b) a preformed polymer;
  (c) a core monomer or mixture of monomers;
  (d) an initiator or initiators; and
  (e) an organic shell monomer dissolved in the core monomer(s);
(2) dispersing the resulting homogeneous mixture into a water phase containing a surfactant or emulsifier and, optionally, a base and/or an antifoaming component;
(3) adding a water soluble second shell component to the reaction mixture while agitating the dispersed core component and organic soluble shell component of the toner in the stabilizing aqueous phase at room temperature, thus effecting interfacial polymerization;
(4) adding an aqueous dispersant solution wherein the dispersant is of the formula as illustrated herein;
(5) increasing the temperature of the suspension to from about 50° C. to about 130° C., thereby effecting free radical polymerization of the core monomers;
(6) thereafter washing the toner thus formed to remove the stabilizing materials; and
(7) subsequently drying the final toner product.

DETAILED DESCRIPTION OF THE INVENTION

There are now being provided a number of specific embodiments of the present invention, however, other embodiments not specifically disclosed, including equivalents thereof, are encompassed by the present invention especially if many of the objectives or some of the objectives thereof are achievable.

The toner compositions of the present invention in one embodiment are comprised of an encapsulated toner composition comprised of a core comprised of preformed polymer, and/or a monomer or monomers which are subsequently polymerized; pigment or dye particles; a stabilizer component; a dispersant, available from, for example, W. R. Grace Chemical Company, of the following formula

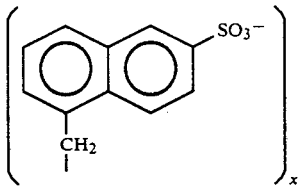

wherein x represents the number of repeating units in the polymeric chain up to, for example, 200, it is believed, with the chain length depending on the degree of polymerization, and wherein the core is encapsulated within a polymeric shell and stabilized at elevated temperatures by the dispersant.

In one embodiment, with the process of the present invention wherein microencapsulation is selected, there can be obtained a thin heat fusible polymeric shell with a relatively low glass transition temperature of from about 70° C. to about 100° C. and wherein interfacial condensation polymerization processes are selected, which processes can be accomplished at room temperature. Interfacial polymerization is accomplished in some embodiments around a colored, pigmented or dyed core material containing, for example, components with low glass transition temperatures of, for example, less than 55° C. Moreover, with the aforementioned process during the interfacial polymerization or immediately prior thereto, especially prior to core monomer polymerization, an aqueous solution of the dispersing agents illustrated herein, including naphthalene sulfonate formaldehyde condensate materials available as Daxad TM from W. R. Grace Chemical Company are added thereto, which dispersants are of importance particularly in maintaining particle stability and preventing or minimizing particle agglomeration and coalescence during the free radical polymerization, for example.

The encapsulated toners of the present invention can be prepared in one embodiment by providing a preformed polymer, such as a copolymer comprised of about 52 percent by weight of styrene and 48 percent by weight of n-butyl methacrylate, and a flushed pigment, such as Lithol Scarlet in a copolymer resin comprised of about 65 percent by weight of styrene and about 35 percent by weight of n-butyl methacrylate where the pigment to copolymer ratio is 45:55, and monomer or monomers, such as styrene and n-butyl methacrylate or stearyl methacrylate in a 50:50 ratio, forming an organic phase with initiators and an organic shell component comprised of an isocyanate or an acid chloride; dispersing the aforementioned organic phase into a surfactant emulsifier solution; adding to the resulting mixture an aqueous shell component such as a diamine; effecting interfacial polymerization; followed by adding thereto a dispersant, such as those of Daxad TM commercially available from W. R. Grace Chemical Company; and subsequently effecting free radical polymerization.

Further, in accordance with the present invention there are provided black and colored encapsulated toner compositions, which comprises mixing with from about 10 to about 55 percent by weight of water, and from about 60 to about 100 percent by weight of a core monomer in a core monomer/polymer mixture, including acrylates, methacrylates, and the like, such as butyl acrylate, n-butyl methacrylate, lauryl methacrylate, hexyl methacrylate, 2-ethylhexyl methacrylate, stearyl methacrylate, propyl acrylate, benzyl acrylate, pentyl acrylate, hexyl acrylate, 2-ethylhexyl acrylate, cyclohexyl acrylate, dodecyl acrylate, ethoxy propyl acrylate, heptyl acrylate, isobutyl acrylate, methyl butyl acrylate, m-tolyl acrylate, dodecyl styrene, hexyl methyl styrene, nonyl styrene, tetradecyl styrene, or other substantially equivalent vinyl monomers; and combinations of vinyl monomers with an azo type free-radical initiator such as azoisobutyronitrile, azodimethylvaleronitrile, azobiscyclohexanenitrile, 2-methylbutyronitrile, and mixtures thereof, or peroxide type free radical initiators such as benzoyl peroxide and lauroyl peroxide and mixtures thereof, and the like; adding pigment particles, including colored organic pigments or dyes, in an amount of from about 1 to 15 percent by weight of the toner; or magnetites, colored magnetites or carbon blacks in an amount of from about 5 to about 70 percent by weight of the toner; or other similar solid inert materials of a particle size of from about submicron, for example, less than 1 micron to about 5 microns; adding an organic soluble shell comonomer, such as isocyanates including toluene diisocyanate, meta-tetramethylxylene diisocyanate (m-TMXDI), sebacoyl chloride, adipic acid, toluene bischloroformate, hexanedisulfonic acid; and optionally adding a shell cross-linking agent such Desmodur RF (Bayer); and subsequently by addition of a water soluble shell comonomer such as amines, such as diethylene triamine, 1,3-cyclohexanebis(methylamine), hexane diamine, hexmethylenediamine, bisphenol A or any other water soluble copolycondensation coreactant to the suspension, accomplishing an interfacial polymerization at the interface of the aforementioned mixture; effecting the addition of a dispersant such as Daxad TM to stabilize the resulting particles in a subsequent core polymerization process; and thereafter affecting a free radical polymerization by heating the suspension and allowing the disassociation of chemical initiator to free-radicals and initiation of free-radical polymerization by the reaction with core monomer(s).

Illustrative examples of core monomers present in an effective amount of, for example, from about 60 to about 99 percent by weight of the core monomer/polymer mixture includes, as indicated herein, acylates, methacrylates, diolefins, and the like. Specific examples of core monomers are butyl acrylate, butyl methacrylate, lauryl methacrylate, hexyl methacrylate, 2-ethylhexyl methacrylate, stearyl methacrylate, hexyl acrylate, styrene, cyclohexyl acrylate, dodecyl acrylate, ethoxy propyl acrylate, 2-ethylhexyl acrylate, heptyl acrylate, isobutyl acrylate, methyl butyl acrylate, m-tolyl acrylate, dodecyl styrene, hexyl methyl styrene, nonyl styrene, tetradecyl styrene, other known vinyl monomers, reference for example U.S. Pat. No. 4,298,672, the disclosure of which is totally incorporated herein by reference, polylaurylmethacrylate, mixtures thereof; and the like.

In one specific embodiment of the present invention, the encapsulated toner is formulated by an interfacial/free radical polymerization process in which the shell formation and the core formation are independently controlled. The core materials selected for the toner composition can be blended together, followed by encapsulation thereof within a polymeric material, and adding a dispersant prior to core monomer polymerization. The encapsulation process is preferably accomplished by an interfacial polymerization reaction, and the core monomer polymerization process generally takes place by means of a free radical reaction. More specifically, the process includes the steps of preparing a core material by mixing a blend of a core monomer or monomers, one or more free radical polymerization initiators, a pigment or pigments and dyes, a first shell monomer, and optionally, a core polymer or polymers; forming an organic liquid phase which is dispersed into an aqueous phase containing a water soluble surfactant or emulsifier to form an oil in water suspension; and the addition of a water soluble second shell monomer preferably with constant agitation, thus subjecting the mixture to an interfacial polymerization at room temperature.

About half way after the interfacial polymerization or prior to core polymerization, an aqueous solution of the dispersing agent is added to stabilize the already formed discrete toner particles through the monomer polymerization step at elevated temperatures. After the interfacial polymerization is complete and the dispersant solution is added, the free radical polymerization of the core monomers within the encapsulated core is effected by increasing the temperature of the suspension, thereby enabling the initiator to initiate polymerization of the core monomers and resulting in a toner composition comprising a polymeric core containing dispersed pigment or dye encapsulated by a polymeric shell. Free radical polymerization of the core monomers generally is accomplished at a temperature of from about 50° C. to about 130° C., and preferably from about 60° C. to about 120° C., for a period of from about 8 hours to about 24 hours. The toner material can then be washed to remove the stabilizing materials and subsequently dried, preferably utilizing known spray drying techniques. Further details regarding encapsulation by interfacial/free radical polymerization are illustrated in U.S. Pat. No. 4,727,011, the disclosure of which is totally incorporated herein by reference.

In a specific embodiment, the process of the present invention comprises the preparation of encapsulated toner compositions formulated by an interfacial/free radical polymerization process in which the shell formation and the core formation are controlled independently. The core materials selected for the toner composition are blended together, followed by encapsulation thereof within a polymeric material, followed by core monomer polymerization. The encapsulation process generally takes place by means of an interfacial polymerization reaction, and the core monomer polymerization processes are generally accomplished by means of a free radical reaction as indicated herein. More specifically, the process includes the steps of preparing a core material by mixing a blend of a core monomer or monomers, one or more free radical polymerization initiators, a pigment or pigments, a first shell monomer, and optionally, a core polymer or polymers; forming an organic liquid phase which is dispersed into an aqueous phase containing a water soluble surfactant to form an oil in water suspension; the addition of a water soluble second shell monomer during constant agitation, thus subjecting the mixture to an interfacial polymerization at room temperature. After the interfacial polymerization is completed and prior to free radical polymerization, the aqueous Daxad TM dispersant solution is added, and free radical polymerization of the core monomers within the encapsulated core is effected by increasing the temperature of the suspension, thereby enabling the initiator to initiate polymerization of the core monomers resulting in a toner composition comprising a polymeric core containing dispersed pigment encapsulated by polymeric shell. Free radical polymerization of the core monomers generally is accomplished at a temperature of from about 50° C. to about 130° C., and preferably from about 60° C. to about 120° C., for a period of from about 8 hours to about 24 hours. The toner material can then be washed to remove the stabilizing materials and subsequently dried, preferably utilizing spray drying.

With respect to the polymeric core material, preformed polymers in effective amounts of, for example, from about 10 to about 70 weight percent, may be included as a component of the core. These polymers are compatible with and readily soluble in the core monomers. Examples of suitable polymers include polymers of the monomers illustrated herein as suitable core monomers, as well as copolymers of these monomers, such as styrene-butadiene copolymers, styrene-acrylate and styrene-methacrylate copolymers, ethylene-vinylacetate copolymers, isobutylene-isoprene copolymers, and the like.

Monomers may be present in the core during the particle formation step, and subsequently these monomers can be polymerized by a free radical polymerization process after the shell has been formed in an interfacial polymerization process. Typical core monomers (60 to 99 weight percent) include styrene, α-methylstyrene, vinyl toluene, n-alkyl methacrylates, n-alkyl acrylates, branched alkyl methacrylates, branched alkylacrylates, chlorinated olefins, butadiene, styrene-butadiene oligomers, ethylene-vinyl acetate oligomers, isobutylene-isoprene copolymers with residual double bonds of low molecular weight where the weight average molecular weight ($M_w$) is from about 5,000 to about 20,000 vinyl-phenolic materials, alkoxy alkoxy alkyl acrylates, alkoxy alkoxy alkyl methacrylates, cyano alkyl acrylates and methacrylates, alkoxy alkyl acrylates and methacrylates, methyl vinyl ether, maleic anhydride, and the like. These monomers may be present alone or as mixtures of monomers to form copolymers. The monomers may also be present in conjunction with preformed polymers, thus subsequent to polymerization of the core monomer there results a polymer blend, preferably in a 1:1 ratio of two polymers, which may be both a compatible blend, wherein the polymers are miscible and form a uniform, homogeneous mixture, or an incompatible blend, wherein one polymer is present in discrete regions or domains within the other polymer. Also, a "flush" of the desired organic pigment in a preformed polymer, for example Hostaperm Pink E, in a copolymer resin comprised of about 65 percent by weight of styrene and about 35 percent by weight of n-butyl methacrylate, can be mixed with styrene and/or acrylate monomers to form the core material, and these monomers can be subsequently polymerized after shell formation to generate the fully polymerized core in which the dispersion of pigment is extremely uniform. For the process of the present invention, the different colored toners need not contain the same core monomers or polymers since, for example, the charging characteristics of the toners are determined by the shell material.

Waxes or wax blends may also be added to the core preferably in amounts of from about 0.5 percent by weight to about 20 percent by weight of the core to, for example, improve the low melting properties and/or release properties of the toner. Specific examples of waxes include candelilla, beeswax, sugar cane wax, carnuba wax, paraffin wax and other similar waxes, particularly those with a melting point of about 60° C.

Any suitable colored pigments may be selected for the toners and the process of the present invention provided, for example, that they are unreactive with the components employed to form the shell in the interfacial polymerization process and that they do not undesirably or substantially interfere with the free radical polymerization of the core monomer or monomers. Typical pigments present in effective amounts of, for example, 1 to about 20 weight percent that may be used are Violet Toner VT-8015 available from Paul Uhlich, Inc., Normandy Magenta RD-2400 (Paul Uhlich), Paliogen Violet 5100 (BASF), Paliogen Violet 5890 (BASF), Permanent Violet VT2645 (Paul Uhlich), Heliogen Green L8730 (BASF), Argyle Green XP-111-S (Paul Uhlich), Brilliant Green Toner GR 0991 (Paul Uhlich), Lithol Scarlet D3700 (BASF), Tolidine Red (Aldrich), Scarlet for Thermoplast NSD PS PA (Ugine Kuhlmann of Canada), E.D. Toluidine Red (Aldrich), Lithol Rubine Toner (Paul Uhlich), Lithol Scarlet 4440 (BASF), Bon Red C (Dominion Color Company), Royal Brilliant Red RD-8192 (Paul Uhlich), Oracet Pink RF (Ciba-Geigy), Paliogen Red 3871K (BASF), Paliogen Red 3340 (BASF), Lithol Fast Scarlet L4300 (BASF), Heliogen Blue L6900, L7020 (BASF), Heliogen Blue K6902, K6910 (BASF), Heliogen Blue D6840, D7080 (BASF), Sudan Blue OS (BASF), Neopen Blue FF4012 (BASF), PV Fast Blue B2G01 (American Hoechst), Irgalite Blue BCA (Ciba-Geigy), Paliogen Blue 6470 (BASF), Sudan III (red orange) (Matheson, Coleman, Bell), Sudan II (orange) (Matheson, Coleman, Bell), Sudan IV (orange) (Matheson, Coleman, Bell), Sudan Orange G (Aldrich), Sudan Orange 220 (BASF), Paliogen Orange 3040 (BASF), Ortho Orange OR 2673 (Paul Uhlich), Paliogen Yellow 152, 1560 (BASF), Lithol Fast Yellow 0991K (BASF), Paliotol Yellow 1840 (BASF), Novoperm Yellow FGL (Hoechst), Permanent Yellow YE 0305 (Paul Uhlich), Lumogen Yellow D0790 (BASF), Suco-Gelb L1250 (BASF), Suco-Yellow D1355 (BASF), Sico Fast Yellow D1355, D1351 (BASF), Hostaperm Pink E (American Hoechst), Fanal Pink D4830 (BASF), Cinquasia Magenta (DuPont), Paliogen Black L0084 (BASF), Pigment Black K801 (BASF), magnetites up to 75 weight percent, and carbon blacks such as Regal 330® (Cabot), Carbon Black 5250 and Carbon Black 5750 (Columbian Chemicals Company), mixtures thereof, and the like.

Any suitable free radical initiator may be employed particularly when the core material is prepared by a free radical polymerization subsequent to the interfacial polymerization reaction that forms the toner shell providing, for example, that the 10 hour half-life of the initiator is less than about 120° C., and preferably less than about 90° C. Suitable free radical initiators include azo type initiators, such as 2,2'-azobis(isobutyronitrile), 2,2'-azobis(2,4-dimethylvaleronitrile), 2,2'-azobis(cyclohexanenitrile), 2,2'-azobis-(2-methylbutyronitrile), 2,2'-azobis(2,4-dimethyl-4-methoxyvaleronitrile), mixtures thereof, and the like. Additional free radical initiators also include peroxide type initiators such as benzoyl peroxide, lauroyl peroxide and 2,5-dimethyl-2,5-bis(2-ethylhexanoylperoxy)hexane, Lupersol 256® (Pennwalt), or any combination thereof. Typically, a low temperature reacting initiator can be present in the core material, which initiator is activated at temperatures of from about 50° C. to about 65° C. The low temperature initiator is generally present in an amount of from about 0.5 to about 6 percent by weight of the core monomer or monomers, and preferably from about 2 to about 4 percent by weight of the core monomers. Optionally, a high temperature initiator may also be present in the core material being activated at temperatures of over 65° C. The high temperature initiator may be present in amounts of from 0.1 to about 2 percent by weight of the core monomer(s), and preferably from about 0.5 to about 1.25 percent by weight of the core monomer(s).

Suitable shell monomers generally are selected from monomers wherein the number of chemical reacting groups per molecule is two or more. The number of reacting groups per molecule is referred to as the chemical functionality. An organic soluble shell monomer which has a functionality of two or more reacts with the aqueous soluble shell monomer which has a functionality of two or more by interfacial polymerization to produce the shell polymer. Examples of organic soluble shell monomers with a functionality equal to two are sebacoyl chloride, terephthaloyl chloride, phthaloyl chloride, isophthaloyl chloride, azeloyl chloride, glutaryl chloride, adipoyl chloride and hexamethylene diisocyanate purchased from Fluka; 4,4'-dicyclohexylmethane diisocyanate (Desmodur W), and a 80:20 mixture of 2,4- and 2,6-toluene diisocyanate (TDI) purchased from Mobay Chemical Corporation; trans-1,4-cyclohexane diisocyanate obtained from Aldrich, metatetramethylxylene diisocyanate (m-TMXDI) from American Cyanamid and 4,4'-methyldiphenyl diisocyanate (Isonate 125M or MDI) obtained from The Upjohn Company. Examples of crosslinking organic soluble shell monomers which have a functionality of greater than two are: 1,3,5-benzenetricarboxylic acid chloride obtained from Aldrich; Isonate 143L (liquid MDI based on 4,4'-methyldiphenyl diisocyanate) obtained from The Upjohn Company, and tris(isocyanatophenyl) thiophosphate (Desmodur RF) obtained from Mobay Chemical Corporation. Examples of shell monomers soluble in aqueous media and with a functionality of two include 1,6-hexanediamine, 1,4-bis(3-aminopropyl)-piperazine, 2-methylpiperazine, m-xylene-α,α'-diamine, 1,8-diamino-p-menthane, 3,3'-diamino-N-methyldipropylamine and 1,3-cyclohexanebis(methylamine) obtained from Aldrich; 1,4-diaminocyclohexane and 2-methylpentanediamine (Dytek A) obtained from DuPont; 1,2-diaminocyclohexane, 1,3-diaminopropane, 1,4-diaminobutane, 2,5-dimethylpiperazine and piperazine purchased from Fluka; fluorine-containing 1,2-diaminobenzenes obtained from PCR Incorporated; and N,N'-dimethylethylenediamine obtained from Alfa. Other aqueous soluble shell monomers having a functionality greater than two are diethylenetriamine and bis(3-aminopropyl)amine obtained from Fluka and tris(2-aminoethyl)amine, Tren-HP TM obtained from W. R. Grace Chemical Company, and the like.

More than one organic phase shell monomer can be selected to react with more than one aqueous phase shell monomer. Although formation of the shell entails reaction between at least two shell monomers, one soluble in an organic phase and one soluble in an aqueous phase, as many as five or more monomers soluble in the organic phase and as many as five or more monomers soluble in the aqueous phase can be reacted to form the shell. In some preferred embodiments of the present invention, two monomers soluble in the organic phase and two monomers soluble in the aqueous phase can be reacted to form the shell.

Another class of shell monomers which can be selected for the aqueous phase or the organic phase as minor shell components are functionalized prepolymers. Prepolymers or macromers are long chain polymeric materials which have low mechanical integrity and low molecular weights, such as weight average molecular weights of less than about 1,000 with functional groups on each end of the molecule that react with the shell monomers and can be incorporated into the shell. Examples of such materials that are available for use in the organic phase are isocyanate prepolymers such as Adiprene L-83 and L-167 available from DuPont, and the like. The class of Jeffamine materials, such as Jeffamine ED-600, ED-900, C-346, DU-700 and EDR-148, available from Texaco Chemical Company, which are aqueous prepolymers, can also be incorporated into the shell as the aqueous soluble monomer.

The colored toner compositions in an embodiment of the present invention generally comprise from about 1 to about 15 percent by weight, and preferably from about 3 to about 10 percent by weight, of the pigment or pigments or dyes, from about 5 to about 50 percent by weight, and preferably from about 7 to about 25 percent by weight, of the polymeric shell, and from about 35 to about 94 percent by weight, and preferably from about 65 to about 90 percent by weight, of the core monomers and polymers. Within the polymeric shell, the molar ratio of the organic soluble monomer to the aqueous soluble monomer is from about 1:1 to about 1:4, and preferably from about 1:1 to about 1:1.5. Within the mixture of core monomers and polymers, the preformed polymers are present in an amount of from 0 to about 40 percent by weight, preferably from about 0 to about 25 percent by weight, of the monomer/polymer mixture, and the monomers are present in an amount of from about 60 to about 100 percent by weight, and preferably from about 75 to about 100 percent by weight, of the monomer/polymer mixture. The addition of a dispersant, such as Daxad TM, is usually added prior to core polymerization in an amount of from about 2.5 to about 25 percent by weight of water.

An example of the process of the present invention for the preparation of colored toner compositions comprises:

(1) preparing a core component comprising
  (a) selected pigment particles, such as Hostaperm Pink E, in an amount of about 7 percent by weight of the toner, wherein the pigment is flushed into a resin comprising a styrene-n-butylmethacrylate copolymer (about 65 percent styrene and about 35 percent n-butyl methacrylate), which resin is present in an amount approximately equal to the amount (by weight) of the pigment particles;
  (b) a preformed polymer, for example a styrene-n-butyl methacrylate copolymer (about 52 percent by weight of styrene and about 48 percent by weight of n-butyl methacrylate), present in an amount that the total percent weight of this preformed polymer plus the preformed polymer into which the pigment has been flushed is about 20 percent by weight of the core monomer/polymer mixture component of the toner;
  (c) a core monomer or mixture of monomers, present in an amount of about 80 percent by weight of the core monomer/polymer mixture component of the toner, wherein the total amount of monomers plus preformed polymers is about 73 percent by weight of the toner in this embodiment;
  (d) an initiator or initiators present in an amount of from about 0.5 to about 6 percent by weight of the core, and preferably from about 2 to about 4 percent by weight of the core monomer, for a low temperature reacting initiator, and from about 0.1 to about 2 percent by weight of the core monomer(s), and preferably from about 0.5 to about 1.25 percent by weight of the core monomer(s), for a higher temperature reacting initiator; and
  (e) an organic soluble shell monomer dissolved in the core monomers present in an amount of about 10 percent by weight of the toner composition;

(2) dispersing the resulting homogeneous mixture into a water phase containing a surfactant or emulsifier and, optionally, a base like sodium hydroxide and/or an antifoaming component, such as an aliphatic alcohol such as 2-decanol;

(3) adding a water soluble second shell component in an amount of about 10 percent by weight of the toner to the reaction mixture while agitating the dispersed core component and organic soluble shell component of the toner in the stabilizing aqueous phase at room temperature, thus effecting interfacial polymerization;

(4) adding an aqueous dispersent solution, preferably comprised of Daxad TM;

(5) after about two hours of constant agitation at room temperature, increasing the temperature of the suspension to a temperature of from about 50° C. to about 130° C., and preferably from about 60° C. to about 120° C. for about 8 hours to about 24 hours, and preferably from about 8 hours to about 18 hours, thereby effecting free radical polymerization of the core monomers;

(6) thereafter washing the toner thus formed to remove the stabilizing materials; and (7) subsequently drying the final toner product, preferably employing the spray drying process.

Shell polymers suitable for use with the present invention include those as indicated herein, which shells may be formed in an interfacial polymerization process. Typical shell polymers include polyureas, polyurethanes, polyesters, thermotropic liquid crystalline polyesters, polycarbonates, polyamides, polysulfones, and the like, or mixtures of these polymers such as poly(urea-urethanes), poly(esteramides), and the like, which can be formed in a polycondensation reaction of suitably terminated prepolymers or macromers with different condensation monomers. For example, a preformed alcohol terminated urethane prepolymer can be copolymerized with a diacyl halide to form a poly(ester-urethane) in an interfacial reaction, or an amine terminated amide prepolymer can be copolymerized with a diisocyanate to produce a poly(urea-amide) copolymer. Epoxy monomers or oligomers such as Epikote 819 can also be added in amounts of from about 0.01 percent to about 30 percent to copolymerize into the shell as strengthening agents. Various polyfunctional shell monomers, such as triamines, triisocyanates, and triols can be employed in small quantities of from about 0.01 percent to about 30 percent as crosslinking agents to introduce rigidity and strength into the shells.

A surfactant or emulsifier can be added to disperse the hydrophobic particles in the form of toner size droplets in the aqueous medium and for stabilization of these droplets against coalescence or agglomeration prior to shell formation and encapsulation of the core. Many types of surfactants can be employed if desired, such as poly(vinylalcohol), polyethylene sulfonic acid salt, polyvinylsulfate ester salt, carboxylated polyvinylalcohol, water soluble alkoxylated diamines or similar water soluble block copolymers, gum arabic, polyacylic acid salt, carboxymethylcellulose, hydroxypropylcellulose, hydroxyethylcellulose, quaternary amine functionalized cellulose derivatives such as JR 400, block copolymers of propylene oxide and ethylene oxide, gelatins, including succinated gelatin salts of alginic acid. In addition, water soluble inorganic salts may also be employed to stabilize the dispersion, such as trisodium polyphosphate, tricalcium polyphosphate, and the like.

Examples of interfacial polymerization processes suitable for formation of the polymeric shell are illustrated in U.S. Pat. Nos. 4,000,087 and 4,307,169, the disclosures of which are totally incorporated herein by reference.

Illustrative examples of dispersants present in effective amounts, for example preferably from about 2.5 percent by weight to about 25 percent by weight of water, include those available from W. R. Grace Chemical Company as Daxad TM, and believed to be of the following formula

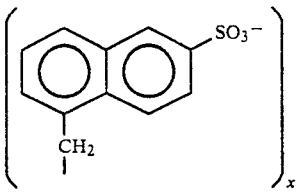

wherein x represents the number of repeating units including, for example, from 1 to about 200; and comprised of low and high molecular weight naphthalene sulfonate formaldehyde condensate materials such as Daxad TM 11G, 17, 19, 19K, and the like. Naphthalene sulfonate formaldehyde condensate materials are also commercially available from GAF Corporation as, for example, Humifer ® NB2-85 or Blancol ® N.

Examples of pigments, some of which are illustrated hereinabefore, include red, green, blue, brown, Heliogen Blue L6900, D6840, D7080, D7020, Pylam Oil Blue and Pylam Oil Yellow, Pigment Blue 1 available from Paul Uhlich & Company Inc., Pigment Violet 1, Pigment Red 48, Lemon Chrome Yellow DCC 1026, E.D. Toluidine Red and Bon Red C available from Dominion Color Corporation Ltd., Toronto, Ont., NOVAperm Yellow FGL, Hostaperm Pink E available from Hoechst, Cinquasia Magenta available from E. I. DuPont de Nemours & Company, and Oil Red 2144 available from Passaic Color and Chemical. Generally, colored pigments that can be selected are cyan, magenta, or yellow pigments, and mixtures thereof. Examples of magenta materials that may be selected as pigments include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyan materials that may be used as pigments include copper tetra-4(octadecyl sulfonamido) phthalocyanine, X-copper phthalocyanine pigment listed in the Color Index as CI 74160, CI Pigment Blue, and Anthrathrene Blue, identified in the Color Index as CI 69810, Special Blue X-2137, and the like; while illustrative examples of yellow pigments that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. The aforementioned pigments are incorporated into the encapsulated toner compositions in various suitable effective amounts providing the objectives of the present invention are achieved. In one embodiment, these colored pigment particles are present in the toner composition in an amount of from about 1 percent by weight to about 15 percent by weight calculated on the weight of the dry toner. Colored magnetites, such as mixtures of Mapico Black, and cyan components may also be selected as pigments with the process of the present invention.

Surface additives can be selected for the toners of the present invention including, for example, metal salts, metal salts of fatty acids, colloidal silicas, mixtures thereof, and the like, which additives are usually present in an amount of from about 0.1 to about 1 weight percent, reference U.S. Pat. Nos. 3,590,000; 3,720,617; 3,655,374 and 3,983,045, the disclosures of which are totally incorporated herein by reference. Preferred additives include zinc stearate and Aerosil ® R972.

Surface charge control agents or additives can be added to the toner particles by numerous known methods. These additives thus can be incorporated into the toner shell by the addition thereof to the surfactant or emulsifier phase, therefore, during interfacial polymerization of the shell the surface charge control agent is physically incorporated into the shell. This process is particularly suitable when one portion of the charge control agent is functionalized with a group such as an amine, thus, the charge control agent reacts as a minor aqueous shell component and is chemically incorporated into the shell. During the interfacial polymerization, the surface charge control agent diffuses toward the outer boundary of the shell and is thus located on the shell surface. Examples of surface charge control agents suitable for incorporation into the shell material include fumed or colloidal silicas such as the Aerosils ®, aluminas, talc powders, metal salts, metal salts of fatty acids such as zinc stearate, cetyl pyridinium salts, distearyl dimethyl ammonium methyl sulfate, and the like. Preferably the charge control agents are colorless compounds that do not interfere with the purity of color of the toners. Generally, the surface charge enhancing additives when incorporated as a component of the shell are present in an amount of from about 0.1 percent to about 20 percent by weight of the aqueous shell component.

Surface charge control agents can also be blended onto the surface of the toner particles subsequent to particle formation. After particle formation and prior to spray drying, the surface charge control agent can be added to the aqueous suspension of the washed particles, thus during the spray drying process the charge control agent adheres to the shell surface. Surface charge control additives can also be dry blended onto the dry toner surface in a tumbling/shearing apparatus such as a Lodige blender. Examples of surface charge control additives suitable for addition to the toner surface include fumed silicas or fumed metal oxides onto the surface of which have been deposited charge enhancing additives such as cetyl pyridinium chloride, distearyl dimethyl ammonium methyl sulfate, potassium tetraphenyl borate and the like. These surface treated silicas or metal oxides are typically treated with 5 to 25 percent of the charge enhancing agent. The surface charging agents that can be physically absorbed to the toner surface by mechanical means are generally present in an amount of from about 0.01 percent to about 15 percent by weight of the toner and preferably from about 0.1 percent to about 5 percent by weight of the toner.

In a two component development system, toner, about 2 to about 3 percent toner concentration for example, is blended with carrier to develop a triboelectric charge between the toner and carrier. The latitude of tribo is determined by, for example, the selected shell materials and the choice of carrier. Through frictional contact between the carrier and the toner, an electrostatic charge sufficient for development of an electrostatic latent image is produced on the toner and maintained at a predetermined level. Examples of suitable carriers include a carrier comprising a core such as a ferrite spray coated with a thin layer of a polymeric material, 0.1 to 1 weight percent, such as methyl terpolymer comprising about 81 percent methyl methacrylate, about 14 percent styrene and about 5 percent vinyl triethoxysilane; a carrier comprising a non-round, oxidized steel shot core coated with a thin layer of a polymer comprising about 65 percent trifluorochloroethylene and about 35 percent vinyl chloride blended with carbon black; a carrier comprising a steel shot core coated with polyvinylidene fluoride; a carrier comprising a steel shot core coated with a polymer blend comprising about 35 percent by weight of polyvinylidene fluoride and about 65 percent by weight of polymethylmethacrylate; and a carrier comprising a ferrite core coated with a methyl terpolymer comprising about 81 percent methyl methacrylate, about 14 percent styrene and about 5 percent vinyltriethoxysilane blended with carbon black. Other known carriers may be employed to achieve the desired triboelectric charge on the toner, reference U.S. Pat. Nos. 4,937,166 and 4,935,326, the disclosures of which are totally incorporated herein by reference.

Formation of the toner particles by an interfacial polymerization reaction followed by a free radical polymerization of the core monomers results in toner particles having a highly smooth toner particle morphology. The core can be polymerized subsequent to shell formation, yet the viscosity of the pigmented core composition is low enough to allow the dispersion of the core in the aqueous surfactant solution during the primary particle generation step. In most forms of microencapsulation, the core consists of a preformed polymer dissolved in a solvent prior to dispersion in the aqueous phase, as illustrated in, for example, U.S. Pat. Nos. 4,476,211; 4,476,212 and 4,610,945, the disclosures of which are totally incorporated herein by reference, to achieve a sufficiently low viscosity to allow efficient dispersion of both the pigments in the core polymer and dispersion of the organic phase into the aqueous phase. The presence of a solvent in the core, however, can cause problems in some instances. For example, when the solvent is high boiling and not removed on drying of the toner, the imaged toners may have very poor smear properties, and there may also be odor problems and environmental problems associated therewith, for example chlorinated solvents, which can also be possible carcinogens. The solvent recovery step can be costly, and the manufacturing equipment for particle isolation generally must be explosion proof, which also adds to the process cost. When the solvent for the core polymer is low boiling, it can be removed on drying of the toner, then since the particle size is fixed by the interfacial polymerization process while the solvent is still present, the toner particles will collapse to form very wrinkled prune-like particles or collapsed disc-like particles if the shell is sufficiently flexible. This effect generally results in poor flow properties of the toner, and generates complications in the particle preparation process necessitating recovery of the solvent. Alternatively, when the particles have shells which are very rigid, upon escape of the solvent, large voids will be apparent inside the toner capsule resulting in a low bulk density of the toner and a loss of image density for a fixed volume of toner developed. In some instances, escaping solvent can cause the toner shells to explode, or may create holes in the shell on drying. These difficulties are avoided by employing a process as described herein, wherein, for example, the polymeric core is formed by a free radical polymerization subsequent to the formation of the shell.

In addition, the shell of the microencapsulated toner prepared according to the aforementioned processes of the present invention has a high enough glass transition temperature in most embodiments, that is greater than about 60° C., to provide adequate blocking properties and mechanical properties of the toner particles. Core polymerizations by free radical mechanisms may be designed to produce low melting and low energy fusing core polymers that fuse and melt at temperatures of from about −60° C. to about 60° C., which considerably widens the choice of free radical polymerizable monomers suitable for use in toner compositions of this type as compared to the choice available for toners prepared by meltblending methods.

The following examples are being submitted to further define various species of the present invention. These examples are intended to be illustrative only and are not intended to limit the scope of the present invention. Also, parts and percentages are by weight unless otherwise indicated.

EXAMPLE I

The following three Examples (I to III) are included as comparisons to illustrate that without a protective colloid/stabilizing material such as Daxad TM particle agglomeration and undesirable coalescence results when the colored encapsulated toner particles are prepared with heat fusible shells that are designed to fuse to a substrate under low fusing pressures such as 400 psi.

A color heat fusible microencapsulated toner was prepared by the following procedure. Into a polyethylene bottle, 250 milliliters, was added styrene monomer (Polysciences Inc.), 38.33 grams, n-butyl methacrylate monomer (Fluka), 38.33 grams, a copolymer comprised of about 52 percent by weight of styrene and 48 percent by weight of n-butyl methacrylate, 20.02 grams, and Lithol Scarlet NBD-3755 pigment (BASF) flushed into a styrene/n-butyl methacrylate copolymer comprised of 65 percent by weight of styrene and 35 percent by weight of n-butyl methacrylate where the pigment to copolymer ratio was 45/55, 23.33 grams. With the aid of a Burrel wrist shaker, the polymer and pigment were dispersed into the monomers overnight (18 hours). The overall toner composition was 7 percent pigment, 20 percent shell and 73 percent core which was composed of 30 percent preformed polymer and 70 percent monomers. Once the pigmented monomer solution was homogeneous, into the mixture was dispersed 2,2'-azobis(2-methylbutyronitrile) (DuPont), 1.51 grams, again with the aid of the Burrell wrist shaker, for 10 to 15 minutes. Prior to the dispersion of the pigmented core into the aqueous phase, meta-tetramethylxylene diisocyanate, m-TMXDI ® (Cyanamid), 18.5 grams, was added to the core and shaken by hand. Into a stainless steel 2 liter beaker containing 1.0 percent poly(vinylalcohol) solution, weight average molecular weight of 96,000, 88 percent hydrolyzed (Scientific Polymer Products), 600 milliliters, was dispersed the above pigmented monomer solution with a Brinkmann PT45/80 homogenizer and a PTA35/4G probe at 9,000 rpm for 1 minute. The dispersion was performed in a cold water bath at a temperature of 15° C. This mixture was transferred into a 2 liter glass reactor equipped with a mechanical stirrer and an oil bath underneath the beaker. While stirring the solution vigorously, an aqueous solution of 1,3-cyclohexane-bis(methylamine) (Aldrich), 11.8 grams, and distilled water, 50 milliliters, was poured into the reactor and the mixture was stirred for 2 hours at room temperature. During this time, interfacial polymerization occurred to form a heat fusible aliphatic-like polyurea shell of low Tg (less than 100° C.). One hour into the interfacial polymerization the protective colloid, a 2 percent solution of Pluronic F38 (BASF), 500 milliliters, was added. The temperature was increased to 85° C. for 18 hours to polymerize the monomeric material via free radical polymerization to form the remaining polymeric core. The solution cooled to room temperature and was washed 10 times by gravity, settling the particles, and decanting off the supernatant layer. The resulting encapsulated particles were screened wet through 425 and 250 micron sieves prior to spray drying using the Yamato-Ohkawara spray dryer model DL-41. The total yield after spray drying was 89.21 grams with an average particle size of 9.5 microns and GSD of 1.67 as determined by a Multisizer Coulter Counter. The thermal properties of the particles which were measured on the Shimadzu Melt Flow Tester Model CFT-500A evidenced a glass transition temperature Tg, a softening temperature Ts, an initial flowing temperature $T_{f1}$, an additional flowing temperature, where approximately half of the material has moved or flowed through the 1 millimeter orifice, $T_{f2}$, and a final flowing temperature, where all of the sample has flown through the die, $T_{f3}$. For this sample the Tg was 55° C., Ts was 115° C., $T_{f1}$ was 155° C., $T_{f2}$ was 188° C. and $T_{f3}$ was 194° C. as compared to a toner comprised of 88 percent of a styrene n-butyl methacrylate copolymer (58/42), 88 weight percent, 10 weight of Regal 330® carbon black, and 2 percent by weight of the charge enhancing additive cetyl pyridinium chloride with the following thermal properties also measured on the Shimadzu Flow Tester; Tg was 55° C., Ts was 85° C., $T_{f1}$ was 105° C., $T_{f2}$ was 126° C., and $T_{f3}$ was 135° C. The Scanning Electron Microscopy (SEM) micrographs indicated clusters of aggregated primary particles forming agglomerates where the surfaces of the particles comprised a majority of very fine particles, less than 1 micron in average diameter size. Even with such a high concentration of surfactant, 1 percent poly(vinylalcohol), and a protective colloid such as Pluronic F38, discrete clean surfaced primary toner particles with a heat fusible shell could not be stabilized throughout the entire reaction.

EXAMPLE II

A color heat fusible microencapsulated toner was prepared by repeating the process of Example I with the following exceptions. Into a polyethylene bottle, 250 milliliters, was added styrene monomer (Polysciences Inc.), 43.8 grams instead of 38.33 grams, n-butyl methacrylate monomer (Fluka), 43.8 grams instead of 38.33 grams, a copolymer comprised of about 52 percent by weight of styrene and 48 percent by weight of n-butyl methacrylate, 11.4 grams instead of 20.02 grams and Hostaperm Pink E pigment (Hoechst) predispersed into a styrene/n-butyl methacrylate copolymer composed of 65 percent by weight of styrene and 35 percent by weight n-butyl methacrylate where the pigment to copolymer ratio was 50/50, 21.0 grams instead of 23.33 grams. The overall toner composition was comprised of 7 percent pigment, 20 percent shell and 73 percent core which was composed of 20 percent preformed polymer instead of 30 percent, and 80 percent monomers instead of 70 percent. Once the pigmented monomer solution was homogeneous, into the mixture was dispersed 2,2'-azobis(2-methylbutyronitrile) (DuPont), 3.5 grams instead of 1.51 grams, with the aid of the Burrell wrist shaker for 10 to 15 minutes. The particles were isolated by spray drying using the Yamato-Ohkawara spray dryer model DL-41. The total yield after spray drying was 61.70 grams with an average particle size of 9.3 microns and GSD $(d_{84}/d_{16})^{\frac{1}{2}}$ of 1.56 as determined by a Multisizer Coulter Counter. The thermal properties for this sample were measured on the Shimadzu Melt Flow Tester; Tg was 85° C., Ts was 155° C., $T_{f1}$ was 195° C., $T_{f2}$ was 213° C. and $T_{f3}$ was 219° C. The Scanning Electron Microscopy (SEM) micrographs showed clusters of aggregated primary particles forming agglomerates where the surfaces of the particles consisted of a lot of very fine particles, less than 1 micron in size. Even with such a high concentration of surfactant, 1 percent poly(vinylalcohol) and a protective colloid such as Pluronic F38, discrete clean surfaced primary toner particles with a heat fusible shell could not be stabilized throughout the entire reaction.

EXAMPLE III

A color heat fusible microencapsulated toner was prepared by repeating the process of Example I with the following exceptions. Into a polyethylene bottle, 250 milliliters, was added styrene monomer (Polysciences Inc.), 61.33 grams instead of 38.33 grams, n-octadecyl methacrylate monomer also know as stearyl methacrylate monomer (Scientific Polymer Products), 15.33 grams, instead of n-butyl methacrylate monomer, 38.33 grams, a copolymer consisting of about 52 percent by weight of styrene and 48 percent by weight of n-butyl methacrylate, 20.02 grams, and Lithol Scarlet NBD-3755 pigment (BASF) flushed into a styrene/n-butyl methacrylate copolymer composed of 65 percent by weight of styrene and 35 percent by weight n-butyl methacrylate where the pigment to copolymer ratio was 45/55, 23.33 grams. Once the pigmented monomer solution was homogeneous, into the mixture was dispersed 2,2-azobis(2,4-dimethylvaleronitrile) (Polysciences Inc.), 3.066 grams, and 2,2'-azobis(2-methylbutyronitrile) (DuPont), 0.77 grams instead of 1.51 grams, with the aid of the Burrell wrist shaker for 10 to 15 minutes. Into a stainless steel 2 liter beaker containing 4.0 percent of Pluronic F108 (BASF) and 0.4 percent of poly(vinylalcohol) solution, weight average molecular weight of 96,000, 88 percent hydrolyzed (Scientific Polymer Products), 600 milliliters, instead of 1.0 percent of poly(vinylalcohol) solution, 600 milliliters, was dispersed the above pigmented monomer solution with a Brinkmann PT45/80 homogenizer and a PTA-35/4G probe at 7,500 rpm instead of 9,000 rpm for 1 minute. After transferring the dispersed organic/aqueous mixture into a reaction kettle while stirring the solution, an aqueous solution of 1,3-cyclohexanebis(methylamine) (Aldrich), 10.6 grams instead of 11.8 grams, along with tris(2-aminoethyl)amine, tradename Tren-HP TM (W. R. Grace), 1.2 grams and distilled water, 50 milliliters, was poured into the reactor. The particles were isolated by spray drying using the Yamato-Ohkawara spray dryer model DL-41. The total yield after spray drying was 86.19 grams with an average particle size of 11.8 microns and GSD $(d_{84}/d_{16})^{\frac{1}{2}}$ of 1.62 as determined by a Multisizer Coulter Counter. The thermal properties for this encapsulated toner sample were measured on the Shimadzu Melt Flow Tester; Tg was 58° C., Ts was 100° C., $T_{f1}$ was 140° C., $T_{f2}$ was 171° C. and $T_{f3}$ was 179° C. Scanning Electron Microscopy (SEM) micrographs showed clusters of aggregated primary particles forming agglomerates where the surfaces of the particles consisted of a lot of very fine particles, less than 1 micron in size. Even with such a high concentration of surfactant, 4 percent of Pluronic F108/0.4 percent of poly(vinylalcohol) and a protective colloid such as Pluronic F38, discrete clean surfaced primary toner particles with a heat fusible shell could not be stabilized throughout the entire reaction.

The following six Examples are included to illustrate that with the incorporation of a Daxad TM dispersent, discrete primary particles are isolated which contain both a heat fusible shell and core that are designed to fuse to a substrate under low fusing pressures such as 400 psi. All parts and percentages are by weight unless otherwise indicated.

EXAMPLE IV

A color heat fusible microencapsulated toner was prepared by the following procedure. Into a polyethylene bottle, 250 milliliters, was added styrene monomer (Polysciences Inc.), 43.8 grams, n-butyl methacrylate monomer (Fluka), 43.8 grams, a copolymer comprised of about 52 percent by weight of styrene and 48 percent by weight of n-butyl methacrylate, 11.4 grams, and Hostaperm Pink E (Hoechst) flushed into a styrene/n-butyl methacrylate copolymer comprised of 65 percent by weight of styrene and 35 percent by weight of n-butyl methacrylate where the pigment to copolymer ratio was 50/50, 21.0 grams. With the aid of a Burrell wrist shaker, the polymer and pigment were dispersed into the monomers overnight (12 hours). The composition contained 7 percent pigment, 20 percent shell and 73 percent core which was composed of 20 percent preformed polymer and 80 percent monomer. Once the pigmented monomer solution was homogeneous, into the mixture was dispersed 2,2'-azobis(2-methylbutyronitrile) (DuPont), 1.75 grams, with the aid of the Burrell wrist shaker for 10 to 15 minutes. Prior to the dispersion of the pigmented core into the aqueous phase, meta-tetra methylxylene diisocyanate, m-TMXDI ® (Cyanamid), 18.5 grams, was added to the core and shaken by hand. Into a stainless steel 2 liter beaker containing 1.0 percent poly(vinylalcohol) solution, weight average molecular weight of 96,000, 88 percent hydrolyzed (Scientific Polymer Products), 600 milliliters, was dispersed the above pigmented monomer solution with a Brinkmann PT45/80 homogenizer and a PTA-35/4G probe at 9,000 rpm for 1 minute. The dispersion was performed in a cold water bath at a temperature of 15° C. This mixture was transferred into a 2 liter glass reactor equipped with a mechanical stirrer and an oil bath underneath the beaker. While stirring the solution vigorously, an aqueous solution of 1,3-cyclohexanebis(methylamine) (Aldrich), 10.6 grams, tris(2-aminoethyl)amine, tradename Tren-HP TM (W. R. Grace), 1.2 grams, and distilled water, 50 milliliters, was poured into the reactor and the mixture was stirred for 2 hours at room temperature. During this time, the interfacial polymerization occurred to form a heat fusible aliphatic-like polyurea shell of low Tg (less than 100° C.). One hour into the interfacial polymerization the protective colloid dispersent, a 10 percent solution of Daxad TM 17 (W. R. Grace), 500 milliliters, was added. The temperature was increased to 85° C. for 18 hours to polymerize the monomeric material via free radical polymerization to form the remaining polymeric core. The solution cooled to room temperature and was washed 10 times by gravity settling the particles and decanting off the supernatant layer. The particles were screened wet through 425 and 250 micron sieves prior to spray drying using the Yamato-Ohkawara spray dryer model DL-41. The total yield after spray drying was 74.29 grams with an average particle size of 7.1 microns and GSD of 1.60 as determined by a Multisizer Coulter Counter. The thermal properties of the resulting encapsulated particles were measured on the Shimadzu Melt Flow Tester Model CFT-500A evidencing a glass transition temperature Tg, a softening temperature Ts, an initial flowing temperature $T_{f1}$, an additional flowing temperature, where approximately half of the material has flowed through the 1 millimeter orifice, $T_{f2}$, and a final flowing temperature, where all of the sample has flowed through the die, $T_{f3}$. For this toner sample the Tg was 95° C., Ts was 170° C., $T_{f1}$ was 205° C., $T_{f2}$ was 218° C. and $T_{f3}$ was 224° C. as compared to a commercial toner comprised of 88 weight percent of styrene n-butyl methylacrylate (58/42), 10 weight percent of carbon black, and 2 weight percent of the charge additive cetyl pyridinium chloride with the following thermal properties also measured on the Shimadzu Flow Tester; Tg was 55° C., Ts was 85° C., $T_{f1}$ was 105° C., $T_{f2}$ was 126° C., and $T_{f3}$ was 135° C. Scanning Electron Microscopy (SEM) micrographs for the prepared encapsulated toner showed discrete spherical heat fusible particles that were not stuck together. In a two component development system where the developer is composed of carrier beads (steel coated with a methyl terpolymer, 0.6 weight percent; toner concentration 2.5) and the above prepared encapsulated toner particles, the toner particles fused to a paper substrate under low pressure conditions of about 400 psi.

EXAMPLE V

A color heat fusible microencapsulated toner was prepared by the following procedure. Into a polyethylene bottle, 250 milliliters, was added styrene monomer (Polysciences Inc.), 43.8 grams, n-hexyl methacrylate (Scientific Polymer Products), 43.8 grams, a copolymer consisting of about 52 percent by weight of styrene and 48 percent by weight of n-butyl methacrylate, 11.4 grams, and Hostaperm Pink E (Hoechst) flushed into a styrene/n-butyl methacrylate copolymer comprised of 65 percent by weight of styrene and 35 percent by weight of n-butyl methacrylate where the pigment to copolymer ratio was 50/50, 21.0 grams. With the aid of a Burrell wrist shaker, the polymer and pigment were dispersed into the monomers overnight (18 hours). The overall toner composition was 7 percent pigment, 20 percent shell and 73 percent core which was composed of 20 percent preformed polymer and 80 percent monomer. Once the pigmented monomer solution was homogeneous, into the mixture was dispersed 2,2'-azobis(2-methylbutyronitrile) (DuPont), 1.75 grams again with the aid of the Burrell wrist shaker for 10 to 15 minutes. Prior to the dispersion of the pigmented core into the aqueous phase, meta-tetramethylxylene diisocyanate, m-TMXDI ® (Cyanamid), 18.5 grams, was added to the core and shaken by hand. Into a stainless steel 2 liter beaker containing 1.0 percent of poly(vinylalcohol) solution, weight average molecular weight of 96,000, 88 percent hydrolyzed (Scientific Polymer Products), 600 milliliters, was dispersed the above pigmented monomer solution with a Brinkmann PT45/80 homogenizer and a PTA-35/4G probe at 9,000 rpm for 1 minute. The dispersion was performed in a cold water bath at a temperature of 15° C. This mixture was transferred into a 2 liter glass reactor equipped with a mechanical stirrer and an oil bath underneath the beaker. While stirring the solution vigorously, an aqueous solution of 1,3-cyclohexane-bis(methylamine) (Aldrich), 10.6 grams, tris(2-aminoethyl)amine, Tren-HP TM (W. R. Grace), 1.2 grams, and distilled water, 50 milliliters, was poured into the reactor and the mixture was stirred for 2 hours at room temperature. During this time, the interfacial polymerization occurred to form a heat fusible aliphatic-like polyurea shell of low Tg (less than 100° C.). One hour into the interfacial polymerization the protective colloid dispersent, a 10 percent solution of Daxad TM 17 (W. R. Grace), 500 milliliters, was added. The temperature was increased to 85° C. for 18 hours to polymerize the monomeric material via free radical polymerization to form the remaining polymeric core. The solution cooled to room temperature and was washed 10 times by gravity settling the particles and decanting off the supernatant layer. The particles were screened wet through 425 and 250 micron sieves prior to spray drying using the Yamato-Ohkawara spray dryer model DL-41. The total toner yield after spray drying was 78.6 grams with an average particle size of 9.3 microns and GSD of 1.58 as determined by a Multisizer Coulter Counter. The thermal properties of the encapsulated toner particles were measured on the Shimadzu Melt Flow Tester Model CFT-500A evidencing a glass transition temperature Tg, a softening temperature Ts, an initial flowing temperature $T_{f1}$, an additional flowing temperature, where approximately half of the material has flowed through the 1 millimeter orifice, $T_{f2}$, and a final flowing temperature, where all of the sample has flowed through the die, $T_{f3}$. For this toner, the Tg was 80° C., Ts was 160° C., $T_{f1}$ was 195° C., $T_{f2}$ was 211° C. and $T_{f3}$ was 213° C. as compared to the commercial toner of Example IV with the following thermal properties also measured on the Shimadzu Flow Tester; Tg was 55° C., Ts was 85° C., $T_{f1}$ was 105° C., $T_{f2}$ was 126° C., and $T_{f3}$ was 135° C. The Scanning Electron Microscopy (SEM) micrographs showed discrete spherical heat fusible particles that were not stuck together for the toner of this Example V. In a two component development system where the developer is composed of carrier beads such as steel, ferrites, iron, and the like with a polymeric coating, reference U.S. Ser. No. 136,792, the disclosure of which is totally incorporated herein by reference, and the prepared encapsulated toner particles, the toner particles fused to a paper substrate with pressure rollers under low pressure conditions of about 400 psi.

EXAMPLE VI

A color heat fusible microencapsulated toner was prepared by the following procedure. Into a polyethylene bottle, 250 milliliters, was added styrene monomer (Polysciences Inc.), 43.8 grams, n-decyl methacrylate (Scientific Polymer Products), 43.8 grams, a copolymer consisting of about 52 percent by weight of styrene and 48 percent by weight of n-butyl methacrylate, 11.4 grams, and Hostaperm Pink E (Hoechst) flushed into a styrene/n-butyl methacrylate copolymer composed of 65 percent by weight of styrene and 35 percent by weight of n-butyl methacrylate where the pigment to copolymer ratio was 50/50, 21.0 grams. With the aid of a Burrell wrist shaker, the polymer and pigment were dispersed into the monomers overnight. The overall toner composition was 7 percent pigment, 20 percent shell and 73 percent core which was comprised of 20 percent preformed polymer and 80 percent monomer. Once the pigmented monomer solution was homogeneous, into the mixture was dispersed 2,2'-azobis(2-methylbutyronitrile) (DuPont), 1.75 grams with the aid of the Burrell wrist shaker for 10 to 15 minutes. Immediately prior to the dispersion of the pigmented core into the aqueous phase, meta-tetramethylxylene diisocyanate, m-TMXDI ® (Cyanamid), 18.5 grams, was added to the core and shaken by hand. Into a stainless steel 2 liter beaker containing 1.0 percent of poly(vinylalcohol) solution, weight average molecular weight of 96,000, 88 percent hydrolyzed (Scientific Polymer Products), 600 milliliters, was dispersed the above pigmented monomer solution with a Brinkmann PT45/80 homogenizer and a PTA-35/4G probe at 9,000 rpm for 1 minute. The dispersion was performed in a cold water bath at a temperature of 15° C. The resulting mixture was transferred into a 2 liter glass reactor equipped with a mechanical stirrer and an oil bath underneath the beaker. While stirring the solution vigorously, an aqueous solution of 1,3-cyclohexane-bis(methylamine) (Aldrich), 10.6 grams, tris(2-aminoethyl)amine, Tren-HP TM (W. R. Grace), 1.2 grams, and distilled water, 50 milliliters, was poured into the reactor and the mixture was stirred for 2 hours at room temperature. During this time, the interfacial polymerization occurred to form a heat fusible aliphatic-like polyurea shell of low Tg (less than 100° C.). One hour into the interfacial polymerization the protective colloid dispersant, a 10 percent solution of Daxad TM 17 (W. R. Grace), 500 milliliters, was added. The temperature was increased to 85° C. for 18 hours to polymerize the monomeric material by free radical polymerization to form the remaining polymeric core. The solution cooled to room temperature and was washed 10 times by gravity settling the particles and decanting off the supernatant layer. The toner particles were screened wet through 425 and 250 micron sieves prior to spray drying using the Yamato-Ohkawara spray dryer model DL-41. The total toner yield after spray drying was 85.28 grams with an average particle size of 7.0 microns and GSD of 1.61 as determined by a Multisizer Coulter Counter. The thermal properties of the resulting encapsulated toner particles were measured on the Shimadzu Melt Flow Tester Model CFT-500A showing a glass transition temperature Tg, a softening temperature Ts, an initial flowing temperature $T_{f1}$, an additional flowing temperature, where approximately half of the material has flowed through the 1 millimeter orifice, $T_{f2}$, and a final flowing temperature, where all of the sample has flowed through the die, $T_{f3}$. For this toner the Tg was 60° C., Ts was 110° C., $T_{f1}$ was 155° C., $T_{f2}$ was 166° C. and $T_{f3}$ was 179° C. as compared to the commercial toner of Example IV with the following thermal properties also measured on the Shimadzu Flow Tester; Tg was 55° C., Ts was 85° C., $T_{f1}$ was 105° C., $T_{f2}$ was 126° C., and $T_{f3}$ was 135° C. The Scanning Electron Microscopy (SEM) micrographs showed discrete spherical heat fusible particles that were not stuck together for the encapsulated toner of this Example VI. In a two component development system where the developer is composed of the carrier beads of Example IV and the above prepared encapsulated toner particles, the toner particles fused to a paper substrate under low pressure conditions of only about 400 psi.

EXAMPLE VII

Into a polyethylene bottle, 250 milliliters, was added styrene monomer (Polysciences Inc.), 43.8 grams, n-octadecyl methacrylate (Scientific Polymer Products), 43.8 grams, a 52/48 ratio of styrene/n-butyl methacrylate preformed polymer resin, 11.4 grams, and Hostaperm Pink E pigment (Hoechst) predispersed into a 65/35 ratio of styrene/n-butyl methacrylate preformed polymer resin where the pigment to polymer ratio was 50/50, 21.0 grams. With the aid of a Burrell wrist shaker, the polymer and pigment were dispersed into the monomers for 24–48 hours. The overall toner composition is 7 percent by weight of pigment, 20 percent shell and 73 percent core which is composed of 9.6 percent copolymer resin composed of 65 percent of styrene and 35 percent of n-butyl methacrylate, 10.4 percent of copolymer resin which is composed of 52 percent of styrene and 48 percent of n-butyl methacrylate, 40 percent of styrene monomer and 40 percent of stearyl methacrylate monomer. Once the pigmented monomer solution was homogeneous, into this mixture was dispersed 2,2'-azobis(2-methylbutyronitrile) (Du Pont), 1.75 grams, and meta-tetramethyl xylene diisocyanate (Cyanamid), m-TMXDI®, 18.5 grams, with the aid of the Burrell wrist shaker for 10 minutes. Into a stainless steel 2 liter beaker containing 1 percent of poly(vinylalcohol) solution, weight average molecular weight of 96,000, 88 percent hydrolyzed (Scientific Polymer Products), 600 milliliters, was dispersed the above pigmented monomer solution with a Brinkmann PT45/80 homogenizer and PTA-35/4G probe at 9,000 rpm for 1 minute. The dispersion was performed in a cold water bath at 15° C. This mixture was transferred into a 2 liter glass reactor equipped with a mechanical stirrer and an oil bath under the beaker. While stirring the solution vigorously, an aqueous solution of 1,3-cyclohexanebis(methylamine) (Aldrich), 10.6 grams, tris(2-aminoethyl)amine, TREN-HP TM, W. R. Grace Chemical Company, 1.2 grams, and distilled water, 50 milliliters, was poured into the reactor and the mixture was stirred for 2 hours at room temperature. During this time the interfacial polymerization occurred to form an aliphatic-like, polyurea shell of low Tg (less than 100° C.). While still stirring, the volume of the reaction mixture was increased with a dispersant solution comprised of 10 percent Daxad TM 17 (W. R. Grace Chemical Company), 500 milliliters, added one hour into the interfacial polymerization. To initiate core polymerization, the temperature was increased to 85° C. for 18 hours so that the monomers could polymerize via free radical polymerization reaction to produce a solid core. The solution cooled to room temperature and then the particles were washed using an ultrafiltration system (Millipore Corporation) comprised of four 0.65 micron membrane plates in series at a filtrate flow rate of 40 milliliters per minute. Prior to washing, the particles were sieved through 425 and 250 micron screens. The particles were dried with a Yamato-Ohlawara spray dryer model DL-41. The total toner yield after spray drying was 62.64 grams. The average particle size was 9.5 microns with GSD of 1.56. The thermal properties of the above prepared encapsulated toner were measured on the Shimadzu Melt Flow Tester showing a glass transition temperature Tg of 57° C. and the initial flow temperature $Tf_1$ of 146° C. The Scanning Electron Microscopy (SEM) micrographs showed discrete spherical heat fusible particles that were not stuck together. In a two component development system where the developer is composed of the carrier beads of Example IV and the above prepared encapsulated toner particles, the toner particles fused to a paper substrate under low pressure conditions of only about 400 psi.

EXAMPLE VIII

Into a polyethylene bottle, 250 milliliters, was added styrene monomer (Polysciences Inc.), 46.0 grams, n-octadecyl methacrylate also known as stearyl methacrylate monomer (Scientific Polymer Products), 30.66 grams, a copolymer consisting of about 52 percent by weight of styrene and 48 percent by weight of n-butyl methacrylate, 20.02 grams, and Lithol Scarlet NBD-3755 pigment (BASF) flushed into a styrene/n-butyl methacrylate copolymer composed of 65 percent by weight of styrene and 35 percent by weight of n-butyl methacrylate where the pigment to copolymer ratio is 45/55, 23.33 grams. With the aid of a Burrell wrist shaker, the polymer and pigment were dispersed into the monomer for 24 to 48 hours. The overall toner composition was 7 percent by weight of pigment, 20 percent of shell and 73 percent of core which was composed of 30 percent preformed polymer and 70 percent monomer. Once the pigmented monomer solution was homogeneous, into the mixture was dispersed 2,2'-azobis-(2,4-dimethylvaleronitrile) (Polysciences Inc.), 3.066 grams, 2,2'-azobis(2-methylbutyronitrile) (DuPont), 0.77 gram, and metatetramethyl xylene diisocyanate, m-TMXDI®, (Cyanamid), 18.5 grams, by shaking the bottles on the Burrell wrist shaker for 10 minutes. Into a stainless steel 2 liter beaker containing 1.5 percent Fluorad FC-170C (3M Canada Inc.) a nonionic fluorosurfactant and 0.4 percent of poly(vinylalcohol) solution, weight average molecular weight of 96,000, 88 percent hydrolyzed (Scientific Polymer Products), 600 milliliters, was dispersed the above pigmented monomer solution with a Brinkmann PT45/80 homogenizer and a PTA-35/4G probe at 9,000 rpm for 1 minute. The dispersion was performed in a cold water bath at a temperature of 15° C. This mixture was transferred into a 2 liter glass reactor equipped with a mechanical stirrer and an oil bath under the beaker. While stirring the solution vigorously, an aqueous solution of 1,3-cyclohexanebis(methylamine) (Aldrich), 11.8 grams, and distilled water, 50 milliliters, was poured into the reactor and the mixture was stirred for 2 hours at room temperature. During this time, the interfacial polymerization occurred to form an aliphatic-like polyurea shell of low Tg (less than 100° C.). One hour into the interfacial polymerization the protective colloid dispersant, a 10 percent solution of Daxad TM 17, (W. R. Grace Chemical Company), 500 milliliters, was added. The temperature was increased to 85° C. for 18 hours to polymerize the monomeric material via a free radical polymerization to form the remaining polymeric core. The solution cooled to room temperature and was washed 5 times with distilled water by gravity settling and then using an ultrafiltration device (Millipore) at a speed setting of 7 and a flow rate of 50 milliliters per minute for 8 hours. The toner particles were screened wet through 425 and 250 micron sieves prior to use of the ultrafiltration device. The resulting encapsulated toner particles were spray dried using a Yamato-Ohkawara spray dryer model DL-41. The total yield after spray drying was 73.97 grams with the average particle size of 12.8 microns and a GSD of 1.46 as determined by a Coulter Counter. The thermal properties of the toner particles were measured on the Shimadzu Melt Flow Tester Model showing the glass transition temperature Tg, a softening temperature Ts, an initial flowing temperature $Tf_1$, an additional flowing temperature, where approximately half of the material has flowed through the 1 millimeter orifice, $Tf_2$, and a final flowing temperature, where all of the toner sample has flowed through the die, $Tf_3$. For this toner the Tg was 42° C., Ts was 65° C., $Tf_1$ was 90° C., $Tf_2$ was 109° C. and $Tf_3$ was 120° C. as compared to the commerical toner of Example IV with the following thermal properties also measured on the Shimadzu Flow Tester; Tg was 55° C., Ts was 85° C., $Tf_1$ was 105° C., $Tf_2$ was 126° C. and $Tf_3$ was 135° C. The Scanning Electron Microscopy (SEM) micrographs showed discrete spherical heat fusible encapsulated toner particles that were not stuck together. In a two component development system where the developer is composed of the carrier beads of Example IV and the above prepared encapsulated toner particles, the toner particles fused to a paper substrate under low pressure conditions of only 400 psi.

EXAMPLE IX

A color heat fusible microencapsulated toner was prepared by the following procedure. Into a polyethylene bottle, 250 milliliters, was added styrene monomer (Polysciences Inc.), 52.56 grams, stearyl methacrylate (Scientific Polymer Products), 35.04 grams, a copolymer consisting of about 52 percent by weight of styrene and 48 percent by weight of n-butyl methacrylate, 9.07 grams, and Lithol Scarlet NBD-3755 pigment (BASF) flushed into a styrene/n-butyl methacrylate copolymer composed of 65 percent by weight of styrene and 35 percent by weight n-butyl methacrylate where the pigment to copolymer ratio is 45/55, 23.33 grams. With the aid of a Burrell wrist shaker, the polymer and pigment were dispersed into the monomers overnight. The overall toner composition was 7 percent pigment, 20 percent shell and 73 percent core which was composed of 20 percent preformed polymer and 80 percent monomer. Once the pigmented monomer solution was homogeneous, into the mixture was dispersed 2,2'-azobis(2,4-dimethylvaleronitrile) (Polysciences Inc.), 3.504 grams, and 2,2'-azobis(2-methylbutyronitrile) (DuPont), 0.876 gram, with the aid of the Burrell wrist shaker for 10 to 15 minutes. Prior to the dispersion of the pigmented core into the aqueous phase, meta-tetramethylxylene diisocyanate, m-TMXDI® (Cyanamid), 18.5 grams, was added to the core and shaken by hand. Into a stainless steel 2 liter beaker containing 1.0 percent of Fluorad FC-170C (3M Canada Inc.) a nonionic fluorosurfactant and 0.6 percent of poly(vinylalcohol) solution, weight average molecular weight of 96,000, 88 percent hydrolyzed (Scientific Polymer Products), 600 milliliters, was dispersed the above pigmented monomer solution with a Brinkmann PT45/80 homogenizer and a PTA-35/4G probe at 9,000 rpm for 1 minute. The dispersion was performed in a cold water bath at a temperature of 15° C. This mixture was transferred into a 2 liter glass reactor equipped with a mechanical stirrer and an oil bath underneath the beaker. While stirring the solution vigorously, an aqueous solution of 1,3-cyclohexanebis(methylamine) (Aldrich), 11.8 grams, and distilled water, 50 milliliters, was poured into the reactor and the mixture was stirred for 2 hours at room temperature. During this time, the interfacial polymerization occurred to form a heat fusible aliphatic-like polyurea shell of low Tg (less than 100° C.). One hour into the interfacial polymerization the protective dispersant colloid, a 5 percent solution of Daxad® 17 (W. R. Grace), 500 milliliters, was added. The temperature was increased to 85° C. for 18 hours to polymerize the monomeric material via free radical polymerization to form the remaining polymeric core. The solution was cooled to room temperature and was washed 10 times by gravity settling the particles and decanting off the supernatant layer. The resulting encapsulated toner particles were screened wet through 425 and 250 micron sieves prior to spray drying using the Yamato-Ohkawara spray dryer model DL-41. The total toner yield after spray drying was 92.78 grams with an average particle size of 9.2 microns and GSD of 1.57 as determined by a Multisizer Coulter Counter. The thermal properties of the particles were measured on the Shimadzu Melt Flow Tester Model CFT-500A showing the glass transition temperature Tg, a softening temperature Ts, an initial flowing temperature $T_{f1}$, an additional flowing temperature, where approximately half of the material has flowed through the 1 millimeter orifice, $T_{f2}$, and a final flowing temperature, where all of the toner sample has flowed through the die, $T_{f3}$. For the above prepared toner the Tg was less than 20° C., Ts was 85° C., $T_{f1}$ was 127° C., $T_{f2}$ was 144° C. and $T_{f3}$ was 151° C. as compared to the commerical toner of Example IV with the following thermal properties also measured on the Shimadzu Flow Tester; Tg was 55° C., Ts was 85° C., $T_{f1}=105°$ C., $T_{f2}$ was 126° C., and $T_{f3}$ was 135° C. The Scanning Electron Microscopy (SEM) micrographs showed discrete spherical heat fusible particles that were not stuck together. In a two component development system where the developer is composed of the carrier beads of Example IV and the above prepared encapsulated toner particles, the toner particles fused to a paper substrate under low pressure conditions of only 400 psi.

Unless otherwise indicated, for the above Examples with reference to the developer compositions, the toner concentration in each instance was 2.5, and the coating carrier weight was 0.6 percent.

Other embodiments and modifications of the present invention may occur to those skilled in the art subsequent to a review of the present application. These embodiments, modifications, and equivalents thereof, are also included within the scope of this invention.

What is claimed is:

1. An encapsulated toner composition comprised of a core comprised of a preformed polymer and/or monomer or monomers, a free radical initiator, pigment or dye particles, which core is dispersed in an emulsifier solution, and subsequently encapsulated in a polymeric shell and wherein the toner is stabilized by dispersants during core polymerization, which dispersant is of the following formula

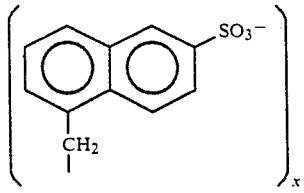

wherein x represents the number of repeating units.

2. A toner in accordance with claim 1 wherein the polymeric shell is obtained by interfacial polymerization.

3. A toner in accordance with claim 1 wherein the core monomer or monomers are polymerized by free radical polymerization.

4. A toner in accordance with claim 1 wherein x is a number of from 1 to about 200.

5. A toner in accordance with claim 1 wherein the shell is comprised of the interfacial polycondensation reaction of a polyfunctional isocyanate and a polyfunctional amine component.

6. A toner in accordance with claim 1 wherein the shell is comprised of the interfacial polycondensation reaction of a first polyfunctional isocyanate component and a second polyfunctional amine component, said first isocyanate component being selected from the group consisting of toluene diisocyanate, meta-tetramethylxylene diisocyanate, hexamethylene diisocyanate, 4,4'-dicyclohexylmethane diisocyanate, trans-1,4-cyclohexane diisocyanate, and tris(isocyanatophenyl)thiophosphate; and said second amine component selected from the group consisting of ethylenediamine, tetramethylenediamine, pentamethylenediamine, hexamethylenediamine, p-phenylenediamine, m-phenylenediamine, 2-hydroxy trimethylenediamine, diethylenetriamine, triethylenetetraamine, tetraethylenepentaamine, 1,8-diaminooctane, xylylene diamine, bis(hexamethylene)-triamine, tris(2-aminoethyl)amine, 4,4'-methylene bis(-cyclohexylamine), bis(3-aminopropyl)ethylene diamine, 1,3-bis(aminomethyl)cyclohexane, 1,5-diamino-2-methylpentane, piperazine, 2-methylpiperazine, 2,5-dimethylpiperazine, 1,4-bis(3-aminopropyl)piperazine, m-xylene-4',4'-diamine, 1,8-diamino-p-menthane, 3,3'-diamino-N-methyldipropylamine, 1,4-diaminocyclohexane, 2-methylpentanediamine, 1,2-diaminocyclohexane, 1,3-diaminopropane, 1,4-diaminobutane, fluorine-containing 1,2-diaminobenzenes, N'N-dimethylethylenediamine bis(3-aminopropyl)-amine and tris(2-aminoethyl)amine.

7. A toner in accordance with claim 1 wherein the core monomer component is selected from the group consisting of acrylates, and methacrylates.

8. A toner composition in accordance with claim 1 wherein the core monomer component is selected from the group consisting of styrene, methylstyrene, vinyl toluene, n-alkyl methacrylates, n-alkyl acrylates, branched alkyl methacrylates, branched alkyl acrylates, chlorinated olefins, butadiene, styrene-butadiene oligomers, ethylene-vinyl acetate oligomers, isobutylene-isoprene copolymers, vinyl-phenolic materials, alkoxy alkoxy alkyl acrylates and methacrylates, cyano alkyl acrylates and methacrylates, alkoxy alkyl acrylates and methacrylates, methyl vinyl ether, maleic anhydride and mixtures thereof.

9. A toner composition in accordance with claim 1 wherein the core polymer component is selected from the group consisting of poly(lauryl methacrylate), poly(dodecyl acrylate), poly(stearyl methacrylate), styrene-lauryl methacrylate copolymer, and poly(dodecyl styrene).

10. A toner composition in accordance with claim 1 wherein the core polymer is selected from the group consisting of styrene-butadiene copolymers, styrene-acrylate copolymers, styrene-methacrylate copolymers, ethylene-vinylacetate copolymers, isobutylene-isoprene copolymers, and mixtures thereof.

11. A toner composition in accordance with claim 1 wherein the pigment particles are magnetite, carbon black, mixtures thereof, red, green, blue, cyan, magenta, yellow, or mixtures thereof; dyes; or colored organic pigments.

12. A toner composition in accordance with claim 3 wherein free radical polymerization initiators are selected from the group consisting of 2,2'-azobis-(isobutyronitrile), 2,2'-azobis(2,4-dimethylvaleronitrile), 2,2'-azobis(cyclohexanenitrile), 2,2'-azobis(2-methylbutyronitrile), 2,2'-azobis(2,4-dimethyl-4-methoxyvaleronitrile), benzoyl peroxide, lauryl peroxide, 2,5-dimethyl-2,5-bis(2-ethylhexanoylperoxy)hexane, and mixtures thereof.

13. A toner composition in accordance with claim 1 wherein the core polymer is poly(lauryl methacrylate); and the first shell monomer is a liquid diphenylmethane diisocyanate, which reacts with a second shell amine monomer 1,4-bis(3-aminopropyl)piperazine to form a partially crosslinked polyurea.

14. A toner composition in accordance with claim 1 wherein the core polymer is poly(lauryl methacrylate); and the first shell monomer is a polymethylene polyphenyl isocyanate, which reacts with a second amine shell monomer 1,4-bis(3-aminopropyl)piperazine to form a partially crosslinked polyurea.

15. A toner composition in accordance with claim 10 wherein the core polymer has a number average molecular weight of from about 5,000 to about 100,000.

16. A toner composition in accordance with claim 1 wherein the core polymer has a ratio of $M_w/M_n$ of from about 1.0 to about 4.

17. A toner composition in accordance with claim 1 wherein the magnetic pigment material comprises from between about 30 to 65 percent by weight of the toner; the core polymer component comprises from between about 10 to about 64 percent by weight of the toner; and the shell materials comprise from between about 6 to about 25 percent by weight of the toner.

18. A toner composition in accordance with claim 1 wherein the pigment or dye comprises from between about 1 to about 15 percent by weight of the toner; the core monomer and polymer component comprise from between about 35 to about 94 percent by weight of the toner; and the shell materials comprise from between about 5 to about 50 percent by weight of the toner.

19. A heat fusible encapsulated colored toner composition comprised of a core comprised of (1) monomer or monomers, which are subsequently polymerized, preformed polymers, or mixtures thereof; (2) pigment, dye particles or mixtures thereof dispersing the aforementioned core in a stabilizer component subsequently encapsulating the resulting components in a polymeric shell where the disperant is of the following formula

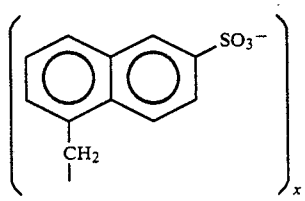

wherein x represents the number of repeating units.

20. A process for the preparation of encapsulated colored toners which comprises preparing a first core material comprising first pigment particles, core monomer or core monomers, and a free radical initiator; preparing a second core material which comprises second pigment particles, core monomer or monomers, and a free radical initiator, said second pigment particles being of a different color from that of the first pigment particles; dispersing the first and second core materials into an aqueous emulsifying phase; encapsulating separately the first core material and the second core material within polymeric shells by interfacial polymerization reactions between at least two shell monomers, of which at least one is soluble in aqueous media and at least one of which is soluble in organic media, wherein the polymeric shell encapsulating the first core material is of substantially the same composition as the polymeric shell encapsulating the second core material; stabilizing the encapsulated toner particles with a dispersant of the following formula

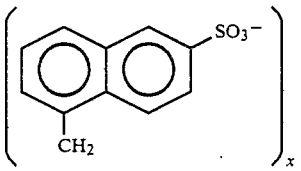

wherein x represents the number of repeating units; and subsequently polymerizing the first and second core monomer or monomers via free radical polymerization, thereby enabling two encapsulated toner compositions of different colors.

21. A process in accordance with claim 20 wherein the two resulting toner compositions have mean particle diameters of less than about 35 microns.

22. A process in accordance with claim 20 wherein the two resulting toner compositions have mean particle diameters of from about 5 to about 15 microns.

23. A process in accordance with claim 20 wherein the core monomers present in the first and second cores are independently selected from the group consisting of styrene, α-methylstyrene, vinyl toluene, n-alkyl methacrylates, n-alkyl acrylates, branched alkyl methacrylates, branched alkyl acrylates, chlorinated olefins, butadiene, styrene-butadiene oligomers, ethylene-vinyl acetate oligomers, isobutylene-isoprene copolymers, vinyl-phenolic materials, alkoxy alkoxy alkyl acrylates, alkoxy alkoxy alkyl methacrylates, cyano alkyl acrylates and methacrylates, alkoxy alkyl acrylates and methacrylates, methyl vinyl ether, maleic anhydride, and mixtures thereof.

24. A process in accordance with claim 20 wherein the first and second cores contain up to 5 core monomers.

25. A process in accordance with claim 20 wherein free radical polymerization initiators are selected from the group consisting of 2,2'-azobis(isobutyronitrile), 2,2'-azobis(2,4-dimethylvaleronitrile), 2,2'-azobis(cyclohexanenitrile), 2,2'-azobis-(2-methylbutyronitrile), 2,2'-azobis(2,4-dimethyl-4-methoxyvaleronitrile), benzoyl peroxide, lauryl peroxide, 2,5-dimethyl-2,5-bis(2-ethylhexanoylperoxy)hexane, and mixtures thereof.

26. A process in accordance with claim 20 wherein the free reduced initiators are present in an amount of from about 0.5 to about 8 percent by weight of the core.

27. A process in accordance with claim 20 wherein there is added to the core at least one polymeric material.

28. A process in accordance with claim 27 wherein the polymeric material is selected from the group consisting of styrene-butadiene copolymers, styrene-acrylate copolymers, styrene-methacrylate copolymers, ethylene-vinylacetate copolymers, isobutylene-isoprene copolymers and mixtures thereof.

29. A process in accordance with claim 27 wherein the polymeric material is obtained from monomers selected from the group consisting of styrene, α-methylstyrene, vinyl toluene, n-alkyl methacrylates, n-alkyl acrylates, branched alkyl methacrylates, branched alkyl acrylates, chlorinated olefins, butadiene, styrene-butadiene oligomers, ethylene-vinyl acetate oligomers, isobutylene-isoprene copolymers, vinyl-phenolic materials, alkoxy alkoxy alkyl acrylates, alkoxy alkoxy alkyl methacrylates, cyano alkyl acrylates and methacrylates, alkoxy alkyl acrylates and methacrylates, methyl vinyl ether, maleic anhydride, and mixtures thereof.

30. A process in accordance with claim 27 wherein the ratio of the amount of the core polymeric material to the amount of core monomer or monomers is from about 0:100 to about 40:60.

31. A process in accordance with claim 27 wherein the core monomers and the polymeric material are present in a total amount of from about 35 to about 94 percent by weight of the toner composition.

32. A process in accordance with claim 20 wherein the core material includes a wax selected from the group consisting of candelilla, beeswax, sugar cane wax, carnuba wax, paraffin wax and mixtures thereof.

33. A process in accordance with claim 32 wherein the wax is present in an amount of from about 0.5 percent to about 20 percent by weight of the core.

34. A process in accordance with claim 20 wherein the first shell monomer is selected from the group consisting of sebacoyl chloride, terephthaloyl chloride, phthaloyl chloride, isophthaloyl chloride, azeloyl chloride, glutaryl chloride, adipoyl chloride, hexamethylene diisocyanate, 4,4'-dicyclohexylmethane diisocyanate, toluene diisocyanate trans-1,4-cyclohexane diisocyanate, meta-tetramethylxylene diisocyanate, 4,4'-methyldiphenyl diisocyanate, 1,3,5-benzenetricarboxylic acid chloride, tris(isocyanatophenyl)thiophosphate, and mixtures thereof.

35. A process in accordance with claim 20 wherein the second shell monomer is selected from the group consisting of ethylenediamine, tetramethylenediamine, pentamethylenediamine, hexamethylenediamine, p-phenylenediamine, m-phenylenediamine, 2-hydroxy trimethylenediamine, diethylenetriamine, triethylenetetraamine, tetraethylenepentaamine, 1,8-diaminooctane, xylylene diamine, bis(hexamethylene)-triamine, tris(2-aminoethyl)amine, 4,4'-methylene bis(-cyclohexylamine), bis(3-aminopropyl)ethylene diamine, 1,3-bis(aminomethyl)cyclohexane, 1,5-diamino-2-methylpentane, piperazine, 2-methylpiperazine, 2,5-dimethylpiperazine, and 1,4-bis(3-aminopropyl)piperazine, m-xylene-α,α'-diamine, 1,8-diamino-p-menthane, 3,3'-diamino-N-methyldipropylamine, 1,4-diaminocyclohexane, 2-methylpentanediamine (Dytek A), 1,2-diaminocyclohexane, 1,3-diaminopropane, 1,4-diaminobutane, fluorine-containing 1,2-diaminobenzenes, N'N-dimethylethylenediamine bis(3-aminopropyl)amine and tris(2-aminoethyl)amine.

36. A process in accordance with claim 20 wherein the polymeric shell is selected from the group consisting of polyureas, polyurethanes, polyesters, thermotropic liquid crystalline polyesters, polycarbonates, polyamides, polysulfones, poly(urea-urethanes), poly(ester-amides), poly(urea-amides), poly(ester-urethane) and mixtures thereof.

37. A process in accordance with claim 20 wherein the polymeric shell is present in an amount of from about 5 to about 50 percent by weight of the toner.

38. A process in accordance with claim 20 wherein from 2 to about 10 shell monomers undergo interfacial polymerization to form the shell.

39. A process in accordance with claim 38 wherein 2 shell monomers undergo interfacial polymerization to form the shell.

40. A process in accordance with claim 20 wherein the two encapsulated toners are subsequently mixed with carrier particles to form developer compositions with similar triboelectric charging characteristics.

41. A process in accordance with claim 20 wherein the interfacial polymerization is accomplished at a temperature of from about 10° C. to about 30° C.

42. A process in accordance with claim 20 wherein the free radical polymerization of the core monomers is accomplished at a temperature of from about 50° C. to about 120° C.

43. A process in accordance with claim 20 wherein the free radical polymerization of the core monomers is effected by heating the monomers for from about 8 hours to about 24 hours.

44. A process in accordance with claim 20 wherein the toner resulting is admixed with carrier particles.

45. A process according to claim 20 wherein the toner is admixed with carrier particles which are selected from the group consisting of a ferrite core with a coating comprising a methyl terpolymer which comprises methyl methacrylate in an amount of about 81 percent by weight, styrene in an amount of about 14 percent by weight, and vinyl triethoxysilane in an amount of about 5 percent by weight; an oxidized steel core with a coating comprising a polymer which comprises trifluorochloroethylene in an amount of about 65 percent by weight and vinyl chloride in an amount of about 35 percent by weight, wherein the polymeric coating also contains carbon black particles; a steel core with a coating comprising polyvinylidene fluoride; a steel core with a coating comprising a polymer blend which comprises about 35 percent by weight of polyvinylidene fluoride and about 65 percent by weight of polymethylmethacrylate; and a ferrite core with a coating comprising a methyl terpolymer which comprises methyl methacrylate in an amount of about 81 percent by weight, styrene in an amount of about 14 percent by weight, and vinyl triethoxysilane in an amount of about 5 percent by weight; and wherein the polymeric coating also contains carbon black particles.

46. A method of imaging which comprises forming a latent image by ion deposition on an electroreceptor; subsequently developing this image with the toner composition of claim 1; and thereafter simultaneously transferring and fixing the image to a suitable substrate.

47. A method of imaging which comprises forming a latent image by ion deposition on an electroreceptor; subsequently developing this image with the toner composition of claim 19, and thereafter simultaneously transferring and fixing the image to a suitable substrate.

48. A method of imaging in accordance with claim 46 wherein there results images with excellent image fixing characteristics.

49. A method of imaging in accordance with claim 47 wherein there results images with excellent image fixing characteristics.

50. A method of imaging in accordance with claim 47 wherein fixing is accomplished at pressures of from about 80 to about 250 pounds per lineal inch.

51. A toner composition in accordance with claim 1 wherein the surface of the toner contains thereon additives selected from the group consisting of fumed silicas and colloidal silicas.

52. A toner composition in accordance with claim 1 wherein the pigments are selected from the group consisting of Violet Toner, Normandy Magenta, Paliogen Violet, Permanent Violet, Heliogen Green, Argyle Green, Brilliant Green Toner, Lithol Scarlet, Toluidine Red, Lithol Rubine Toner, Lithol Scarlet, Bon Red, Royal Brilliant Red, Oracet Pink, Paliogen Red, Lithol Fast Scarlet, Heliogen Blue, Sudan Blue, Neopen Blue, PV Fast Blue, Irgalite Blue, Paliogen Orange, Ortho Orange, Paliogen Yellow, Lithol Fast Yellow, Paliotol Yellow, Novoperm Yellow FGL, Permanent Yellow, Lumogen Yellow, Suco-Yellow, Sico Fast Yellow, Hostaperm Pink E, Fanal Pink, Cinquasia Magenta, Paliogen Black, Pigment Black, colored magnetites, carbon blacks, and mixtures thereof.

53. A toner composition in accordance with claim 1 wherein the pigment is present in an amount of from about 3 to about 10 weight percent, the polymeric shell is present in an amount of from about 7 to about 25 weight percent, and the core monomer, monomers, or polymer are present in an amount of from about 65 to about 90 percent by weight.

54. A process for the preparation of an encapsulated toner composition which comprises (1) preparing a core component comprising
  (a) pigment particles wherein the pigment is flushed into a resin comprising a styrene-n-butylmethacrylate copolymer;
  (b) a preformed polymer;
  (c) a core monomer or mixture of monomers;
  (d) an initiator or initiators; and
  (e) an organic shell monomer dissolved in the core monomer or monomers;
(2) dispersing the resulting homogeneous mixture into a water phase containing a surfactant or emulsifier and, optionally, a base and/or an antifoaming component;
(3) adding the water soluble second shell component to the reaction mixture while agitating the dispersed core component and organic soluble shell component of the toner in the stabilizing aqueous phase at room temperature, thus effecting interfacial polymerization;
(4) adding an aqueous dispersant solution wherein the dispersant is of the formula of claim 1;
(5) increasing the temperature of the resulting suspension to from about 50° C. to about 130° C., thereby effecting free radical polymerization of the core monomers;
(6) thereafter washing the toner thus formed to remove the stabilizing materials; and
(7) subsequently drying the final toner product.

55. A toner composition in accordance with claim 1 wherein stabilization is accomplished at elevated temperatures and core polymerization is effected by free radical processes.

56. A toner composition in accordance with claim 1 wherein the core is comprised of a preformed polymer.

57. A toner composition in accordance with claim 1 wherein the monomer or monomers are polymerized.

58. A toner composition in accordance with claim 1 wherein the core monomer is a vinyl monomer.

59. A developer composition comprised of the toner of claim 1 and carrier particles.

60. A toner composition in accordance with claim 15 which is stabilized by the dispersant at elevated temperatures.

61. A toner composition in accordance with claim 60 wherein stabilization is effected during core polymerization.

62. A toner composition in accordance with claim 61 wherein core polymerization is accomplished by free radical processes.

63. A colored encapsulated toner composition comprised of a core comprised of a preformed polymer and monomer, a free radical initiator, pigment or dye particles, which core is dispersed in an emulsifier solution, and subsequently encapsulated in a polymeric shell and wherein the toner is stabilized by dispersants during core polymerization, which dispersant is of the following formula

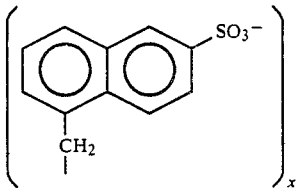

wherein x represents the number of repeating units.

64. An encapsulated toner in accordance with claim 63 wherein x is a number of from 1 to about 20.

65. An encapsulated toner in accordance with claim 63 wherein the pigments are selected from the group consisting of Violet Toner, Normandy Magenta, Paliogen Violet, Permanent Violet, Heliogen Green, Argyle Green, Brilliant Green Toner, Lithol Scarlet, Toluidine Red, Lithol Rubine Toner, Lithol Scarlet, Bon Red, Royal Brilliant Red, Oracet Pink, Paliogen Red, Lithol Fast Scarlet, Heliogen Blue, Sudan Blue, Neopen Blue, PV Fast Blue, Irgalite Blue, Paliogen Orange, Ortho Orange, Paliogen Yellow, Lithol Fast Yellow, Paliotol Yellow, Novoperm Yellow FGL, Permanent Yellow, Lumogen Yellow, Suco-Yellow, Sico Fast Yellow, Hostaperm Pink E, Fanal Pink, Cinquasia Magenta, Paliogen Black, Pigment Black, colored magnetites, carbon blacks, and mixtures thereof.

66. A colored encapsulated heat fusible toner in accordance with claim 63 wherein the toners possess a mean particles diameter of from about 5 to about 35 microns.

67. An encapsulated toner in accordance with claim 63 with narrow size distributions of about 1.5 or less.

68. An encapsulated toner in accordance with claim 63 wherein the toner is comprised of discrete particles subsequent to polymerization.

69. An encapsulated toner in accordance with claim 63 wherein the core of the toner and the shell of the toner are heat fusible.

70. An encapsulated toner in accordance with claim 69 wherein the core is heat fusible at a glass transition temperature of less than 55° C.

71. An encapsulated toner in accordance with claim 1 wherein the shell is heat fusible at a glass transition temperature of less than 100° C.

72. An encapsulated toner in accordance with claim 1 wherein the emulsifier is poly(vinyl alcohol).

73. An encapsulated toner in accordance with claim 1 wherein the emulsifier is polyethylene sulfonic acid salt, polyvinyl sulfate ester salt, carboxylated polyvinyl alcohol, water soluble oxylated diamines, or polyacrylic acid salts.

74. An encapsulated toner in accordance with claim 1 wherein the emulsifier is carboxymethyl cellulose, hydroxypropyl cellulose, or hydroxyethyl cellulose.

75. An encapsulated toner in accordance with claim 63 wherein the emulsifier is poly(vinyl alcohol).

76. An encapsulated toner in accordance with claim 63 wherein the emulsifier is carboxymethyl cellulose, hydroxypropyl cellulose, or hydroxyethyl cellulose.

* * * * *